US009493866B2

(12) United States Patent
Otsuka et al.

(10) Patent No.: US 9,493,866 B2
(45) Date of Patent: Nov. 15, 2016

(54) AMORPHOUS ALLOY POWDER, DUST CORE, MAGNETIC ELEMENT, AND ELECTRONIC DEVICE

(71) Applicant: Seiko Epson Corporation, Tokyo (JP)

(72) Inventors: Isamu Otsuka, Hachinohe (JP); Yu Maeda, Hachinohe (JP); Toshikuni Sato, Hachinohe (JP)

(73) Assignee: Seiko Epson Corporation (JP)

( * ) Notice: Subject to any disclaimer, the term of this patent is extended or adjusted under 35 U.S.C. 154(b) by 287 days.

(21) Appl. No.: 14/191,946

(22) Filed: Feb. 27, 2014

(65) Prior Publication Data

US 2014/0240077 A1 Aug. 28, 2014

(30) Foreign Application Priority Data

| | | |
|---|---|---|
| Feb. 28, 2013 | (JP) | 2013-038584 |
| Feb. 28, 2013 | (JP) | 2013-038585 |
| Feb. 28, 2013 | (JP) | 2013-038586 |
| Feb. 28, 2013 | (JP) | 2013-038587 |
| Feb. 28, 2013 | (JP) | 2013-038588 |

(51) Int. Cl.

| | |
|---|---|
| ***C22C 45/02*** | (2006.01) |
| ***H01F 3/08*** | (2006.01) |
| ***B22F 9/00*** | (2006.01) |
| ***C22C 33/02*** | (2006.01) |
| ***H01F 1/153*** | (2006.01) |
| ***H01F 41/02*** | (2006.01) |
| *B22F 9/08* | (2006.01) |
| *B22F 9/30* | (2006.01) |

(52) U.S. Cl.

CPC ..... *C22C 45/02* (2013.01); *B22F 9/002* (2013.01); *C22C 33/0278* (2013.01); *H01F 1/15308* (2013.01); *H01F 3/08* (2013.01); *H01F 41/0246* (2013.01); *B22F 9/082* (2013.01); *B22F 9/305* (2013.01)

(58) Field of Classification Search

CPC ..... C22C 45/02; H01F 1/20; H01F 1/06; H01F 3/08

USPC ..... 148/304

See application file for complete search history.

(56) References Cited

U.S. PATENT DOCUMENTS

| | | | |
|---|---|---|---|
| 2009/0065100 | A1 | 3/2009 | Yoshizawa et al. |
| 2012/0194309 | A1 | 8/2012 | Nakamura |
| 2013/0255836 | A1 | 10/2013 | Otsuka et al. |

FOREIGN PATENT DOCUMENTS

| | | | |
|---|---|---|---|
| JP | 2000-129307 | A | 5/2000 |
| JP | 2002-060914 | A | 2/2002 |

(Continued)

OTHER PUBLICATIONS

Extended European Search Report for Application No. 14156969.9 dated Mar. 25, 2015 (6 pages).

*Primary Examiner* — Weiping Zhu

(74) *Attorney, Agent, or Firm* — Harness, Dickey & Pierce, P.L.C.

(57) ABSTRACT

An amorphous alloy powder is composed of an amorphous alloy material containing Fe, Cr, Mn, Si, B, and C as constituent components, and in the amorphous alloy material, Fe is contained as a main component, the content of Cr is 0.5 at % or more and 3 at % or less, the content of Mn is 0.02 at % or more and 3 at % or less, the content of Si is 10 at % or more and 14 at % or less, the content of B is 8 at % or more and 13 at % or less, and the content of C is 1 at % or more and 3 at % or less. By using such an amorphous alloy powder, a dust core which reduces iron loss and decreases magnetostriction can be obtained.

29 Claims, 5 Drawing Sheets

(56) References Cited

FOREIGN PATENT DOCUMENTS

| | | | | |
|---|---|---|---|---|
| JP | 2007-152494 | A | | 6/2007 |
| JP | 2007-154046 | A | | 6/2007 |
| JP | 2007-182594 | A | | 7/2007 |
| JP | 2008-106335 | A | | 5/2008 |
| JP | 2008106335 | A | * | 5/2008 |
| JP | 2008-141011 | A | | 6/2008 |
| JP | 2013-213247 | A | | 10/2013 |

* cited by examiner

AMORPHOUS ALLOY POWDER, DUST CORE, MAGNETIC ELEMENT, AND ELECTRONIC DEVICE

BACKGROUND

1. Technical Field

The present invention relates to an amorphous alloy powder, a dust core, a magnetic element, and an electronic device.

2. Related Art

Recently, the reduction in size and weight of mobile devices such as notebook personal computers is significant. Further, the performance of notebook personal computers has been improved to such an extent that it is almost equivalent to that of desktop personal computers.

In order to reduce the size and improve the performance of mobile devices in this manner, it is necessary to increase the frequency of a switching power supply. At present, the driving frequency of a switching power supply has been increased to about several hundred kilo hertz. In response to the increase in the frequency of the switching power supply, it is also necessary to increase the driving frequency of a magnetic element such as a choke coil or an inductor which is built into the mobile device.

For example, JP-A-2007-182594 discloses a ribbon composed of an amorphous alloy containing Fe, M (provided that M is at least one element selected from Ti, V, Zr, Nb, Mo, Hf, Ta, and W), Si, B, and C. It also discloses a core produced by laminating this ribbon and processing the resulting laminate by punching or the like. It is expected that by using such a core, the AC magnetic properties are improved.

However, in the core produced from the ribbon, a significant increase in the Joule loss due to an eddy current (an eddy current loss) may not be avoided in the case where the driving frequency of a magnetic element is further increased.

In order to solve such a problem, a dust core obtained by press-molding a mixture of a soft magnetic powder and a binding material (a binder) is used.

On the other hand, a soft magnetic powder composed of an amorphous alloy material has a high electrical resistance. Due to this, a core containing such a soft magnetic powder can decrease the eddy current loss, and as a result, an iron loss at a high frequency can be decreased. In particular, an Fe-based amorphous alloy has a high saturation magnetic flux density, and therefore is preferred as a soft magnetic material for magnetic devices.

However, an Fe-based amorphous alloy has a large magnetostriction. Therefore, a magnetic device formed from an Fe-based amorphous alloy has a problem that a beat is generated at a specific frequency, and also the improvement of the magnetic properties (e.g., decrease in the coercive force and increase in the magnetic permeability) is inhibited.

SUMMARY

An advantage of some aspects of the invention is to provide an amorphous alloy powder capable of achieving both reduction in the iron loss and improvement of the magnetic properties by decreasing the magnetostriction when being used as a core; a dust core produced by using this amorphous alloy powder; a magnetic element including this dust core, and an electronic device including this magnetic element.

An aspect of the invention is directed to an amorphous alloy powder composed of particles of an amorphous alloy material containing Fe, Cr, Mn, Si, B, and C as constituent components, wherein in the amorphous alloy material, Fe is contained as a main component, the content of Cr is 0.5 at % or more and 3 at % or less, the content of Mn is 0.02 at % or more and 3 at % or less, the content of Si is 10 at % or more and 14 at % or less, the content of B is 8 at % or more and 13 at % or less, and the content of C is 1 at % or more and 3 at % or less.

According to this configuration, an amorphous alloy powder capable of achieving both reduction in the iron loss and improvement of the magnetic properties by decreasing the magnetostriction when being used as a core is obtained.

In the amorphous alloy powder according to the aspect of the invention, it is preferred that the content of Cr in the amorphous alloy material is 1 at % or more and 3 at % or less, and the content of Mn in the amorphous alloy material is 0.1 at % or more and 3 at % or less.

According to this configuration, an amorphous alloy powder capable of further decreasing the iron loss and also further decreasing the magnetostriction so as to further improve the magnetic properties when being used as a core is obtained.

In the amorphous alloy powder according to the aspect of the invention, it is preferred that, when the content of Cr in the amorphous alloy material is represented by a (at %) and the content of Mn therein is represented by b (at %), the value of b/(a+b) is 0.2 or more and 0.72 or less.

According to this configuration, the corrosion resistance of the amorphous alloy powder can be improved and also the coercive force thereof can be decreased.

In the amorphous alloy powder according to the aspect of the invention, it is preferred that, when the content of Cr in the amorphous alloy material is represented by a (at %) and the content of Mn therein is represented by b (at %), the value of a+b is 1.5 or more and 5.5 or less.

According to this configuration, the corrosion resistance of the amorphous alloy powder can be improved and also the coercive force thereof can be decreased while suppressing the decrease in the saturation magnetic flux density of the amorphous alloy powder.

In the amorphous alloy powder according to the aspect of the invention, it is preferred that, when the content of Cr in the amorphous alloy material is represented by a (at %), the content of Mn therein is represented by b (at %), the content of Si therein is represented by c (at %), the content of B therein is represented by d (at %), and the content of C therein is represented by e (at %), the value of (a+b)/(c+d+e) is 0.05 or more and 0.25 or less.

According to this configuration, the balance between the elements having an influence mainly on the coercive force, corrosion resistance, and the like and the elements having an influence mainly on the magnetic permeability, specific resistance, amorphization, and the like is highly desirable. As a result, favorable magnetic properties such as coercive force and magnetic permeability and corrosion resistance can be highly achieved, and further, the amorphous alloy material constituting the amorphous alloy powder can be amorphized and also the size of the particles of the amorphous alloy powder can be decreased.

In the amorphous alloy powder according to the aspect of the invention, it is preferred that, when the content of Mn in the amorphous alloy material is represented by b (at %), the content of Si therein is represented by c (at %), and the content of C therein is represented by e (at %), the value of e/(b+c) is 0.07 or more and 0.27 or less.

According to this configuration, while maintaining excellent magnetic properties, the amorphization of the amorphous alloy material and the spheronization of the particles of the amorphous alloy powder can be reliably achieved.

In the amorphous alloy powder according to the aspect of the invention, it is preferred that the content of Cr in the amorphous alloy material is 1 at % or more and 2.5 at % or less, and the content of Mn in the amorphous alloy material is 1 at % or more and 3 at % or less, and when the content of Cr in the amorphous alloy material is represented by a (at %), the content of Mn therein is represented by b (at %), and the content of C therein is represented by e (at %), the value of e/(a+b) is 0.2 or more and 0.95 or less.

According to this configuration, an amorphous alloy powder capable of producing a dust core, which has a small magnetostriction, and achieves both high magnetic permeability and low coercive force, is obtained.

Further, according to this configuration, the amorphization of the amorphous alloy material is particularly promoted, and the crystalline magnetic anisotropy thereof is particularly decreased, and therefore, the magnetostriction of the amorphous alloy powder can be particularly decreased. On the other hand, the decrease in the saturation magnetic flux density can be minimized, and therefore, an amorphous alloy powder capable of producing a dust core, in which both low coercive force and high saturation magnetic flux density are highly achieved, is obtained.

In the amorphous alloy powder according to the aspect of the invention, it is preferred that the value of a+b is 2.1 or more and 5.3 or less.

According to this configuration, the corrosion resistance of the amorphous alloy powder is particularly improved, and also the electrical resistance between the particles of the amorphous alloy powder can be increased. As a result, an amorphous alloy powder capable of producing a dust core having a small eddy current loss is obtained. Further, since the magnetostriction can be decreased without inhibiting the amorphous atomic arrangement of the particles of the amorphous alloy powder, both decrease in the coercive force and increase in the magnetic permeability can be achieved.

In the amorphous alloy powder according to the aspect of the invention, it is preferred that the value of b/a is 0.4 or more and less than 1.

According to this configuration, the corrosion resistance of the amorphous alloy powder is improved. Further, the amorphization of the amorphous alloy material further proceeds, and thus, the magnetostriction of the amorphous alloy powder can be further decreased. As a result, an amorphous alloy powder having a smaller magnetostriction and higher corrosion resistance is obtained.

In the amorphous alloy powder according to the aspect of the invention, it is preferred that the value of b/a is 1 or more and 2 or less.

According to this configuration, an amorphous alloy powder having a particularly small magnetostriction is obtained.

In the amorphous alloy powder according to the aspect of the invention, it is preferred that, when the content of Si in the amorphous alloy material is represented by c (at %) and the content of B therein is represented by d (at %), the value of b/(c+d) is 0.04 or more and 0.15 or less.

Such an amorphous alloy powder can optimize the decrease in the magnetostriction by the incorporation of Mn in the amorphous alloy material and the increase in the electrical resistance by the incorporation of Si and B therein without canceling each other out. As a result, the eddy current loss can be minimized. Further, when the amorphous alloy material is melted, both manganese oxide and silicon oxide are deposited more on the surface of each particle of the amorphous alloy material in a state where the melting point is low. Due to this, the insulating property on the surface of each particle of the amorphous alloy powder can be improved. As a result, an amorphous alloy powder capable of producing a dust core having a high saturation magnetic flux density, a high magnetic permeability, and a small eddy current loss is obtained.

In the amorphous alloy powder according to the aspect of the invention, it is preferred that the content of Cr in the amorphous alloy material is 2 at % or more and 3 at % or less, and the content of Mn in the amorphous alloy material is 0.02 at % or more and 1 at % or less, and when the content of Cr in the amorphous alloy material is represented by a (at %), the content of Mn therein is represented by b (at %), and the content of C therein is represented by e (at %), the value of e/(a+b) is 0.3 or more and 0.95 or less.

According to this configuration, an amorphous alloy powder which has a small magnetostriction and a high saturation magnetic flux density, and is capable of producing a dust core, in which both high saturation magnetic flux density and low coercive force are achieved, is obtained.

Further, according to this configuration, the amorphization of the amorphous alloy material is particularly promoted, and the crystalline magnetic anisotropy thereof is particularly decreased, and therefore, the magnetostriction can be particularly decreased. On the other hand, the decrease in the saturation magnetic flux density can be minimized, and therefore, an amorphous alloy powder capable of producing a dust core, in which both low coercive force and high saturation magnetic flux density are highly achieved, is obtained.

In the amorphous alloy powder according to the aspect of the invention, it is preferred that the value of a+b is 2.1 or more and 3.8 or less.

According to this configuration, the corrosion resistance of the amorphous alloy powder is particularly improved, and also the electrical resistance between the particles of the amorphous alloy powder can be increased. As a result, an amorphous alloy powder capable of producing a dust core having a small eddy current loss is obtained. Further, the magnetostriction can be decreased without inhibiting the amorphous atomic arrangement of the particles of the amorphous alloy powder, and thus, both decrease in the coercive force and increase in the magnetic permeability can be achieved.

In the amorphous alloy powder according to the aspect of the invention, it is preferred that the value of b/a is 0.02 or more and less than 0.47.

According to this configuration, the decrease in the coercive force and the increase in the magnetic permeability can be further enhanced.

In the amorphous alloy powder according to the aspect of the invention, it is preferred that, when the content of Si in the amorphous alloy material is represented by c (at %) and the content of B therein is represented by d (at %), the value of b/(c+d) is 0.01 or more and 0.05 or less.

According to this configuration, the decrease in the magnetostriction by the incorporation of Mn in the amorphous alloy material and the increase in the electrical resistance by the incorporation of Si and B therein can be selected without significantly decreasing the saturation magnetic flux density. As a result, while maintaining the saturation magnetic flux density at a relatively high level, the coercive force can be decreased and also the iron loss can be decreased by minimizing the eddy current loss.

In the amorphous alloy powder according to the aspect of the invention, it is preferred that, when the content of Cr in the amorphous alloy material is represented by a (at %) and the content of Mn therein is represented by b (at %), the value of a+b is 1.5 or more and 5.5 or less, and the value of b/a is 0.3 or more and less than 1.

According to this configuration, an amorphous alloy powder which has a small magnetostriction and excellent corrosion resistance, and is capable of producing a dust core, in which both high magnetic permeability and small iron loss are achieved for a long period of time, is obtained.

In the amorphous alloy powder according to the aspect of the invention, it is preferred that the value of b is 0.1 or more and 2.5 or less.

According to this configuration, the magnetostriction of the amorphous alloy material is decreased, and therefore, the coercive force is also decreased. As a result, the hysteresis loss of a dust core formed from the amorphous alloy powder is decreased to decrease the iron loss, and therefore, it becomes possible to decrease the iron loss at a high frequency. Further, as the magnetostriction is decreased, the magnetic permeability is increased, and thus, the magnetic responsiveness of the dust core to the external magnetic field at a high frequency is improved.

In the amorphous alloy powder according to the aspect of the invention, it is preferred that, when the content of Si in the amorphous alloy material is represented by c (at %) and the content of B therein is represented by d (at %), the value of b/(c+d) is 0.01 or more and 0.12 or less.

According to this configuration, an amorphous alloy powder in which the achievement of both of the decrease in the magnetostriction and the amorphization is further enhanced is obtained. That is, an amorphous alloy powder capable of producing a dust core, in which both high magnetic permeability and small iron loss are achieved for a long period of time, is obtained.

In the amorphous alloy powder according to the aspect of the invention, it is preferred that, when the content of Si in the amorphous alloy material is represented by c (at %), the content of B therein is represented by d (at %), and the content of C therein is represented by e (at %), the value of (a+b)/(c+d+e) is 0.05 or more and 0.25 or less.

According to this configuration, the amorphization of the amorphous alloy material and the reduction in the size of the particles of the amorphous alloy powder can be promoted while reducing the contents of the elements other than Fe in the amorphous alloy material as much as possible. As a result, an amorphous alloy powder having a high saturation magnetic flux density and a small magnetostriction can be more reliably obtained.

In the amorphous alloy powder according to the aspect of the invention, it is preferred that, when the content of Cr in the amorphous alloy material is represented by a (at %) and the content of Mn therein is represented by b (at %), the value of a+b is 1.5 or more and 6 or less, and the value of b/a is 1 or more and 2 or less.

According to this configuration, an amorphous alloy powder which has a small magnetostriction, and is capable of producing a dust core, in which both high magnetic permeability and small iron loss are achieved, is obtained.

In the amorphous alloy powder according to the aspect of the invention, it is preferred that the value of b is 0.5 or more and 3 or less.

According to this configuration, the magnetostriction of the amorphous alloy material is decreased, and therefore, the coercive force is also decreased. As a result, the hysteresis loss of a dust core formed from the amorphous alloy powder is decreased to decrease the iron loss, and therefore, it becomes possible to decrease the iron loss at a high frequency. Further, as the magnetostriction is decreased, the magnetic permeability is increased, and thus, the magnetic responsiveness of the dust core to the external magnetic field at a high frequency is improved.

In the amorphous alloy powder according to the aspect of the invention, it is preferred that, when the content of Si in the amorphous alloy material is represented by c (at %) and the content of B therein is represented by d (at %), the value of b/(c+d) is 0.03 or more and 0.15 or less.

According to this configuration, an amorphous alloy powder in which the achievement of both of the decrease in the magnetostriction and the amorphization is further enhanced is obtained. That is, an amorphous alloy powder capable of producing a dust core, which more stably achieves both increase in the magnetic permeability and decrease in the iron loss is obtained.

In the amorphous alloy powder according to the aspect of the invention, it is preferred that, when the content of Si in the amorphous alloy material is represented by c (at %), the content of B therein is represented by d (at %), and the content of C therein is represented by e (at %), the value of (a+b)/(c+d+e) is 0.05 or more and 0.25 or less.

According to this configuration, the amorphization of the amorphous alloy material and the reduction in the size of the particles of the amorphous alloy powder can be promoted while reducing the contents of the elements other than Fe in the amorphous alloy material as much as possible. As a result, an amorphous alloy powder having a high saturation magnetic flux density and a small magnetostriction can be more reliably obtained.

In the amorphous alloy powder according to the aspect of the invention, it is preferred that the particles of the amorphous alloy powder have an average particle diameter of 3 μm or more and 100 μm or less.

According to this configuration, a path through which an eddy current flows can be shortened, and therefore, an amorphous alloy powder capable of producing a dust core in which the eddy current loss is sufficiently reduced is obtained.

In the amorphous alloy powder according to the aspect of the invention, it is preferred that the coercive force is 4 Oe or less.

According to this configuration, the hysteresis loss can be reliably reduced so that the iron loss can be sufficiently decreased.

In the amorphous alloy powder according to the aspect of the invention, it is preferred that an oxygen content in the particles of the amorphous alloy powder is 150 ppm by mass or more and 3000 ppm by mass or less.

According to this configuration, an amorphous alloy powder, in which small iron loss, favorable magnetic properties, and high weather resistance are highly achieved, can be obtained.

In the amorphous alloy powder according to the aspect of the invention, it is preferred that the amorphous alloy powder is produced by using a water atomization method or a high-speed spinning water atomization method. According to this configuration, a molten metal can be cooled particularly quickly, and therefore, an amorphous alloy powder having a high degree of amorphization over a wide alloy composition range is obtained.

Another aspect of the invention is directed to a dust core which is formed using an amorphous alloy powder composed of particles of an amorphous alloy material containing Fe, Cr, Mn, Si, B, and C as constituent components, wherein in the amorphous alloy material, Fe is contained as a main component, the content of Cr is 0.5 at % or more and 3 at % or less, the content of Mn is 0.02 at % or more and 3 at % or less, the content of Si is 10 at % or more and 14 at % or less, the content of B is 8 at % or more and 13 at % or less, and the content of C is 1 at % or more and 3 at % or less.

According to this configuration, a dust core having a small iron loss and excellent magnetic properties is obtained.

Still another aspect of the invention is directed to a magnetic element including the dust core according to the aspect of the intention.

According to this configuration, a magnetic element having a small size and high performance is obtained.

Yet another aspect of the invention is directed to an electronic device including the magnetic element according to the aspect of the invention.

According to this configuration, an electronic device having high reliability is obtained.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
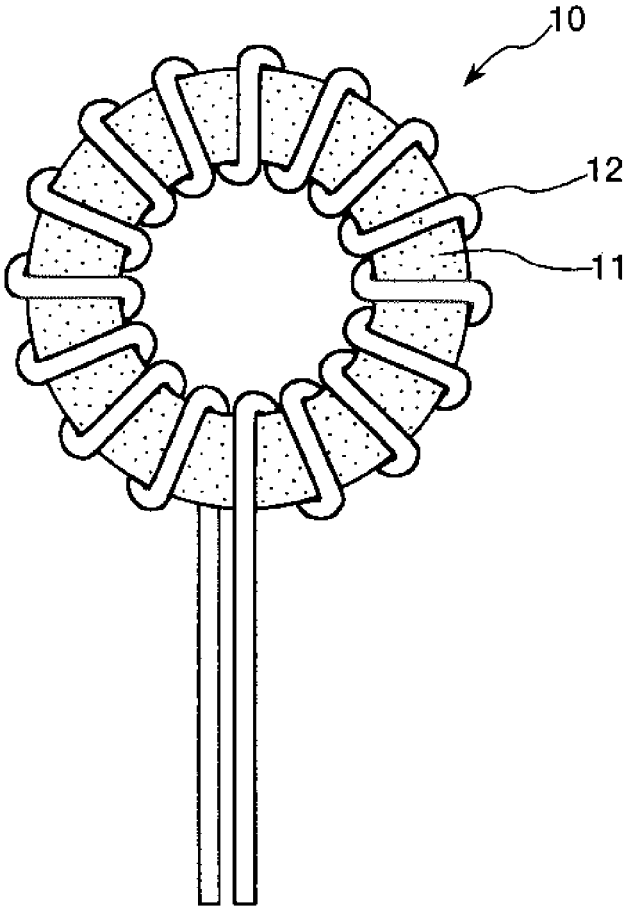
FIG. 1 is a schematic view (a plan view) showing a choke coil, to which a first embodiment of a magnetic element is applied.

Hereinafter, an amorphous alloy powder, a dust core, a magnetic element, and an electronic device will be described in detail based on preferred embodiments shown in the accompanying drawings.

Amorphous Alloy Powder

An amorphous alloy powder is formed into a dust core by forming an insulating film on a surface of each particle as desired, binding the particles to one another through an insulating binder, and molding the powder into a predetermined shape. Such a dust core has excellent magnetic properties at a high frequency, and therefore is used in a variety of magnetic elements.

The amorphous alloy powder is a powder (a soft magnetic powder) composed of particles of an amorphous alloy material containing Fe, Cr, Mn, Si, B, and C, and in the amorphous alloy material, Fe is contained as a main component, the content of Cr is 0.5 at % or more and 3 at % or less, the content of Mn is 0.02 at % or more and 3 at % or less, the content of Si is 10 at % or more and 14 at % or less, the content of B is 8 at % or more and 13 at % or less, and the content of C is 1 at % or more and 3 at % or less.

Such an amorphous alloy powder is an Fe-based amorphous alloy powder, and therefore has a small eddy current loss and a high saturation magnetic flux density, and further has a low coercive force and a high magnetic permeability by the incorporation of Cr and Mn. Therefore, by using this amorphous alloy powder, a dust core having a small iron loss at a high frequency and excellent magnetic properties can be obtained. Further, when the amorphous alloy powder is formed into a dust core, the formed dust core has a small iron loss and excellent magnetic properties, and therefore, the size thereof is easily reduced.

Hereinafter, preferred embodiments of the amorphous alloy powder will be described.

First Embodiment of Amorphous Alloy Powder

First, a first embodiment of the amorphous alloy powder will be described.

The amorphous alloy powder of this embodiment is a powder composed of an amorphous alloy material having an alloy composition represented by $Fe_{100-a-b-c-d-e}Cr_aMn_bSi_cB_dC_e$ (a, b, c, d, and e each represents a content (at %)). Further, a, b, c, d, and e satisfy the following relationships: $1 \le a \le 3$, $0.1 \le b \le 3$, $10 \le c \le 14$, $8 \le d \le 13$, and $1 \le e \le 3$.

That is, the amorphous alloy powder of this embodiment is composed of an amorphous alloy material which contains Fe as a main component, and has a Cr content of 1 at % or more and 3 at % or less, an Mn content of 0.1 at % or more and 3 at % or less, an Si content of 10 at % or more and 14 at % or less, a B content of 8 at % or more and 13 at % or less, and a C content of 1 at % or more and 3 at % or less.

According to this, an amorphous alloy powder capable of further decreasing the iron loss and also further improving the magnetic properties when being used as a core is obtained.

Hereinafter, the amorphous alloy powder of this embodiment will be described in more detail.

Among the constituent elements, Cr (chromium) functions to improve the corrosion resistance of the amorphous alloy material. This results because by incorporating Cr in the amorphous alloy material, the amorphous alloy material is more easily amorphized, and a passive film composed mainly of an oxide of Cr (such as $Cr_2O_3$) is formed on the surface of each particle, and so on. Due to the improvement of the corrosion resistance, oxidation of the amorphous alloy material over time is prevented, and therefore, a decrease in the magnetic properties, an increase in the iron loss, and the like accompanying oxidation can be prevented.

Further, by using Cr in combination with Mn, Cr and Mn synergistically function to improve the corrosion resistance. That is, the amorphous alloy powder having the above-described composition has higher corrosion resistance than in the case where the amorphous alloy material does not contain Mn. This results because on the surface of each particle, a passive film composed mainly of an oxide of Cr is formed, and also Mn or an oxide of Mn has some influence on this passive film so as to strengthen the passive film. Moreover, the atomic size of Mn is very close to that of Cr, and therefore, even if Mn and Cr are used in combination, the improvement of the amorphization of the amorphous alloy material by the incorporation of Cr is not inhibited. Therefore, by adding Cr and Mn at an appropriate ratio, an amorphous alloy powder having particularly high corrosion resistance can be obtained without deteriorating the magnetic properties. Incidentally, in an amorphous alloy powder having high corrosion resistance, it is possible to prevent oxidation from proceeding endlessly. Due to this, for example, the production and storage thereof are facilitated, and also it contributes to the realization of a dust core having high weather resistance.

Further, by forming a passive film having high corrosion resistance, a mechanically firm insulating film is formed on the surface of each particle. Due to this, the electrical resistance in a current path formed between the particles (interparticle resistance) is increased, and thus, a path through which an eddy current flows can be divided into small segments. As a result, an amorphous alloy powder capable of producing a dust core having a small eddy current loss is obtained.

The content of Cr (a) in the amorphous alloy material is 1 at % or more and 3 at % or less. If the content of Cr (a) is lower than the above-described lower limit, depending on the composition of the amorphous alloy material, the decrease in the magnetostriction is insufficient, and therefore, a decrease in the coercive force and an increase in the magnetic permeability of a dust core formed from the amorphous alloy powder may not be able to be achieved. Further, the corrosion resistance is deteriorated, and for example, rust may be caused on a surface of a particle of the amorphous alloy powder to deteriorate the magnetic properties such as the saturation magnetic flux density over time. On the other hand, if the content of Cr (a) exceeds the above-described upper limit, depending on the composition of the amorphous alloy material, the amorphization of the amorphous alloy material is inhibited, and therefore, the crystalline magnetic anisotropy thereof may be increased to increase the magnetostriction. As a result, it may be difficult to decrease the coercive force and increase the magnetic permeability of a dust core formed from the amorphous alloy powder. Further, also the saturation magnetic flux density may be decreased.

The content of Cr (a) is preferably 1.05 at % or more and 2.7 at % or less, more preferably 1.1 at % or more and 2.5 at % or less, and further more preferably 1.2 at % or more and 2.2 at % or less.

Among the constituent elements, Mn (manganese) functions particularly to decrease the magnetostriction of the amorphous alloy material. By decreasing the magnetostriction, also the coercive force is decreased. Due to this, the hysteresis loss of the amorphous alloy material is decreased, and therefore, the iron loss is decreased. Therefore, it is advantageous to decrease the iron loss in a high frequency range. Further, as the magnetostriction is decreased, the magnetic permeability is increased, and thus, the magnetic responsiveness to the external magnetic field at a high frequency is improved.

The reason why such a phenomenon occurs is not clear, but is considered to be as follows. The atomic size of Mn is very close to that of Fe, and thus, it is possible to easily replace an Fe atom with an Mn atom. Therefore, by incorporating a given amount of Mn, the amorphous atomic arrangement of the amorphous alloy material is not inhibited. Further, a change in the dimensions of the crystal lattice (expansion and contraction of the crystal lattice) in the amorphous alloy material by applying a magnetic field is suppressed. Due to this, the magnetostriction is considered to be decreased. It is presume that in this manner, the coercive force is decreased and the magnetic permeability is increased. However, in the case where the amorphous alloy material contains Mn in an excessive amount, the magnetostriction is increased or the saturation magnetic flux density is decreased, and therefore, it is important to carefully select the content of Mn in the amorphous alloy material.

Further, by using Mn in combination with Cr, the above-described effect can be made more remarkable. The reason therefor is not clear either, however, one of the reasons is considered to be as follows. The atomic size of Mn is very close to that of Cr, and therefore, by using appropriate amounts of Mn and Cr in combination, the effect of improving the amorphization of the amorphous alloy material by the incorporation of Cr and the effect of decreasing the magnetostriction due to the improvement of the amorphization are maintained as such. Then, while maintaining these effects, the effect of decreasing the magnetostriction by the incorporation of Mn is synergistically added thereto. As a result, the magnetostriction can be reliably decreased, and also by using appropriate amounts of Mn and Cr in combination, the sum of the contents thereof can be decreased, so that a decrease in the saturation magnetic flux density by the incorporation of Mn or Cr in the amorphous alloy material can be suppressed. Accordingly, by using Mn and Cr in combination, the decrease in the coercive force and the increase in the magnetic permeability of a dust core formed from the amorphous alloy powder can be enhanced, and also the saturation magnetic flux density can be increased.

The content of Mn (b) in the amorphous alloy material is 0.1 at % or more and 3 at % or less. If the content of Mn (b) is lower than the above-described lower limit, depending on the composition of the amorphous alloy material, the magnetostriction is decreased to a limited extent, and therefore, a decrease in the iron loss and an increase in the magnetic permeability may not be able to be achieved. On the other hand, if the content of Mn (b) exceeds the above-described upper limit, depending on the composition of the amorphous alloy material, the amorphization of the amorphous alloy material is inhibited, and therefore, the crystalline magnetic anisotropy thereof may be increased to increase the magnetostriction. As a result, it may be difficult to decrease the coercive force and increase the magnetic permeability of a dust core formed from the amorphous alloy powder. Further, also the saturation magnetic flux density may be decreased.

The content of Mn (b) is preferably 0.5 at % or more and 2.7 at % or less, more preferably 0.7 at % or more and 2.5 at % or less, and further more preferably 1 at % or more and 2.3 at % or less.

Among the constituent elements, Si (silicon) contributes to the increase in the magnetic permeability of the amorphous alloy material. By incorporating a given amount of Si in the amorphous alloy material, the electrical resistance of the amorphous alloy material can be increased, and therefore, the eddy current loss of the amorphous alloy powder can be suppressed. Further, it is also possible to decrease the coercive force.

The content of Si (c) in the amorphous alloy material is 10 at % or more and 14 at % or less. If the content of Si (c) is lower than the above-described lower limit, the magnetic permeability and the electrical resistance of the amorphous alloy material cannot be sufficiently increased, and thus, the improvement of the magnetic responsiveness to the external magnetic field or the reduction in the eddy current loss cannot be sufficiently achieved. On the other hand, if the content of Si (c) exceeds the above-described upper limit, the amorphization of the amorphous alloy material is inhibited, and also the saturation magnetic flux density is decreased, and thus, both reduction in the iron loss and improvement of the magnetic properties cannot be achieved.

The content of Si (c) is preferably 10.3 at % or more and 13.5 at % or less, more preferably 10.5 at % or more and 13 at % or less, and further more preferably 11 at % or more and 12.5 at % or less.

Among the constituent elements, B (boron) decreases the melting point of the amorphous alloy material to facilitate the amorphization thereof. Therefore, it can increase the electrical resistance of the amorphous alloy material and can decrease the eddy current loss of the amorphous alloy powder.

The content of B (d) in the amorphous alloy material is 8 at % or more and 13 at % or less. If the content of B (d) is lower than the above-described lower limit, the melting point of the amorphous alloy material cannot be sufficiently decreased, and therefore, the amorphization of the amorphous alloy material becomes difficult. On the other hand, if the content of B exceeds the above-described upper limit, the melting point of the amorphous alloy material cannot be sufficiently decreased just the same, and therefore, the amorphization of the amorphous alloy material becomes difficult, and also the saturation magnetic flux density is decreased.

The content of B (d) is preferably 8.3 at % or more and 12 at % or less, more preferably 8.5 at % or more and 11.5 at % or less, and further more preferably 8.8 at % or more and 11 at % or less.

Among the constituent elements, C (carbon) decreases the viscosity of the amorphous alloy material when it is melted and facilitates the amorphization and powderization thereof. Therefore, it can increase the electrical resistance of the amorphous alloy material and can decrease the eddy current loss of the amorphous alloy powder. Further, the crystalline magnetic anisotropy of the amorphous alloy material is decreased, and therefore, also the magnetostriction is decreased. As a result, the coercive force of a dust core formed from the amorphous alloy powder can be decreased. Further, by decreasing the viscosity of the amorphous alloy material when it is melted, the reduction in the size of the particles of the amorphous alloy powder and the spheronization thereof can be further facilitated. Accordingly, an amorphous alloy powder having a small particle diameter and a shape relatively close to a spherical shape is obtained. Such an amorphous alloy powder achieves a high packing ability when it is molded into a core, and therefore, contributes to the production of a dust core having a high molding density. By increasing the packing ratio, the magnetic permeability and the saturation magnetic flux density of the thus obtained dust core are further increased.

The content of C (e) in the amorphous alloy material is 1 at % or more and 3 at % or less. If the content of C (e) is lower than the above-described lower limit, the viscosity of the amorphous alloy material when it is melted is increased too much, and the amorphous alloy powder has an irregular shape. Due to this, the packing ability when a dust core is produced cannot be sufficiently increased, and therefore, the saturation magnetic flux density or the magnetic permeability of the dust core to be produced cannot be sufficiently increased. On the other hand, if the content of C (e) exceeds the above-described upper limit, the amorphization of the amorphous alloy material is inhibited, resulting in increasing the coercive force.

The content of C (e) is preferably 1.3 at % or more and 2.8 at % or less, more preferably 1.5 at % or more and 2.6 at % or less, and further more preferably 1.7 at % or more and 2.5 at % or less.

The atomic sizes of Cr and Mn are very close to each other as described above, and therefore Cr and Mn can be made to coexist in the amorphous alloy powder in the form of a complete solid solution. However, the characteristic of the amorphous alloy powder can be appropriated adjusted by changing the magnitude relationship between the contents of Cr and Mn. When the content of Cr is represented by a (at %) and the content of Mn is represented by b (at %), the value of b/(a+b) is preferably 0.2 or more and 0.72 or less, more preferably 0.3 or more and 0.7 or less, and further more preferably 0.4 or more and 0.6 or less. By incorporating Cr and Mn in the amorphous alloy material so as to satisfy this relationship, the balance between the improvement of the corrosion resistance and the decrease in the coercive force can be achieved.

The value of (a+b), which is the sum of the content of Cr (a) and the content of Mn (b), is preferably 1.5 or more and 5.5 or less, more preferably 1.7 or more and 5 or less, and further more preferably 2 or more and 4.5 or less. By incorporating Cr and Mn in the amorphous alloy material so as to satisfy this relationship, the effect of the combination use of Cr and Mn is sufficiently exhibited, and also it is possible to improve the corrosion resistance of the amorphous alloy powder and also decrease the coercive force thereof while suppressing the decrease in the saturation magnetic flux density of the amorphous alloy powder.

Accordingly, the incorporation of Cr and Mn in the amorphous alloy material such that the values of b/(a+b) and (a+b) satisfy the above-described relationships is useful from the viewpoint of highly achieving the magnetic properties (such as saturation magnetic flux density and coercive force) of the amorphous alloy powder and the corrosion resistance.

When the content of Si is represented by c (at %), the content of B is represented by d (at %), and the content of C is represented by e (at %), the value of (a+b)/(c+d+e) is preferably 0.05 or more and 0.25 or less, more preferably 0.07 or more and 0.23 or less, and further more preferably 0.09 or more and 0.2 or less. By incorporating the respective elements in the amorphous alloy material so as to satisfy this relationship, the balance between the elements having an influence mainly on the coercive force, corrosion resistance, and the like and the elements having an influence mainly on the magnetic permeability, specific resistance, amorphization, and the like is achieved. As a result, magnetic properties such as coercive force and magnetic permeability and corrosion resistance can be highly achieved, and also the amorphous alloy material can be amorphized and also the size of the particles of the amorphous alloy powder can be reduced.

Further, the value of (c+d), which is the sum of the content of Si (c) and the content of B (d), is preferably 19 or more and 25 or less, more preferably 20 or more and 24 or less, and further more preferably 21 or more and 23 or less. By incorporating Si and B in the amorphous alloy material so as to satisfy this relationship, both reduction in the iron loss and improvement of the magnetic properties of the amorphous alloy material can be highly achieved without significantly decreasing the saturation magnetic flux density.

It is preferred that the content of Si (c), the content of B (d), and the content of C (e) satisfy the following relationship: c>d>e. According to this, an amorphous alloy powder, in which both small iron loss and excellent magnetic properties are more highly achieved, is obtained.

The value of b/(c+d), which shows the ratio of the content of Mn (b) to the above-described sum (c+d), is preferably 0.01 or more and 0.15 or less, more preferably 0.03 or more and 0.13 or less, and further more preferably 0.05 or more and 0.12 or less. According to this, the decrease in the magnetostriction by the incorporation of Mn in the amorphous alloy material and the increase in the electrical resistance by the incorporation of Si and B therein can be achieved without canceling each other out. As a result, the eddy current loss can be minimized. Further, when the amorphous alloy material is melted, both manganese oxide and silicon oxide are reliably deposited in a state where the melting point is low, and therefore, the insulating property on the surface of each particle of the amorphous alloy powder can be reliably improved. As a result, an amorphous alloy powder capable of reliably producing a dust core having a high saturation magnetic flux density, a high magnetic permeability, and a small eddy current loss is obtained.

Further, the value of d/(b+c), which shows the ratio of the content of B (d) to the sum (b+c) of the content of Mn (b) and the content of Si (c), is preferably 0.5 or more and 1.2 or less, more preferably 0.6 or more and 1.1 or less, and further more preferably 0.7 or more and 1 or less. According to this, by incorporating B in the amorphous alloy material, the melting point of the amorphous alloy material can be reliably decreased without inhibiting the improvement of the magnetic properties. As a result, an amorphous alloy powder capable of reliably producing a dust core having a high saturation magnetic flux density, a high magnetic permeability, and a small eddy current loss is obtained.

Further, the value of e/(b+c), which shows the ratio of the content of C (e) to the sum (b+c) of the content of Mn (b) and the content of Si (c), is preferably 0.07 or more and 0.27 or less, more preferably 0.10 or more and 0.25 or less, and further more preferably 0.15 or more and 0.2 or less. According to this, while maintaining excellent magnetic properties, the amorphization of the amorphous alloy material and the spheronization of the particles of the amorphous alloy powder can be reliably achieved.

Further, the value of b/(d+e), which shows the ratio of the content of Mn (b) to the sum (d+e) of the content of B (d) and the content of C (e), is preferably 0.01 or more and 0.3 or less, more preferably 0.03 or more and 0.25 or less, and further more preferably 0.05 or more and 0.2 or less. According to this, both improvement of the magnetic properties and amorphization can be highly achieved.

Fe is a component whose content (atomic ratio) is the highest in the amorphous alloy material, that is, it is the main component and has a great influence on the basic magnetic properties and mechanical properties of the amorphous alloy powder.

Second Embodiment of Amorphous Alloy Powder

Next, a second embodiment of the amorphous alloy powder will be described.

Hereinafter, with respect to the amorphous alloy powder of this embodiment, different points from the above-described amorphous alloy powder of the first embodiment will be mainly described, and the description of the same matter will be omitted.

The amorphous alloy powder of this embodiment is composed of an amorphous alloy material which contains Fe as a main component, and has a Cr content of 1 at % or more and 2.5 at % or less, an Mn content of 1 at % or more and 3 at % or less, an Si content of 10 at % or more and 14 at % or less, a B content of 8 at % or more and 13 at % or less, and a C content of 1 at % or more and 3 at % or less. Further, when the content of Cr in the amorphous alloy material is represented by a (at %), the content of Mn therein is represented by b (at %), and the content of C therein is represented by e (at %), the value of e/(a+b) is 0.2 or more and 0.95 or less.

Such an amorphous alloy powder has a small magnetostriction by the incorporation of appropriate amounts of Cr and Mn, and also carefully selecting the ratio of the respective elements. Accordingly, by using this amorphous alloy powder, a dust core having a small magnetostriction can be obtained. Such a dust core has both low coercive force and high magnetic permeability, and therefore, the iron loss is small even at a high frequency, and thus, a dust core having favorable magnetic responsiveness even at a high frequency is obtained.

Hereinafter, the amorphous alloy powder of this embodiment will be described in more detail.

The content of Cr in the amorphous alloy material constituting the amorphous alloy powder is 1 at % or more and 2.5 at % or less. If the content of Cr is lower than the above-described lower limit, depending on the composition of the amorphous alloy material, the decrease in the magnetostriction is insufficient, and therefore, a decrease in the coercive force or an increase in the magnetic permeability of a dust core formed from the amorphous alloy powder may not be able to be achieved. Further, the corrosion resistance is deteriorated, and for example, rust may be caused on a surface of a particle of the amorphous alloy powder to deteriorate the magnetic properties such as the saturation magnetic flux density over time. On the other hand, if the content of Cr exceeds the above-described upper limit, depending on the composition of the amorphous alloy material, the amorphization of the amorphous alloy material is inhibited, and therefore, the crystalline magnetic anisotropy thereof may be increased to increase the magnetostriction. As a result, it may be difficult to decrease the coercive force and increase the magnetic permeability of a dust core formed from the amorphous alloy powder. Further, also the saturation magnetic flux density may be decreased.

The content of Cr is preferably 1.5 at % or more and 2.4 at % or less, and more preferably 1.7 at % or more and 2.3 at % or less.

The content of Mn in the amorphous alloy material is 1 at % or more and 3 at % or less. If the content of Mn is lower than the above-described lower limit, depending on the composition of the amorphous alloy material, the magnetostriction is decreased to a limited extent, and therefore, a decrease in the iron loss and an increase in the magnetic permeability may not be able to be achieved. On the other hand, if the content of Mn exceeds the above-described upper limit, depending on the composition of the amorphous alloy material, the amorphization of the amorphous alloy material is inhibited, and therefore, the crystalline magnetic anisotropy thereof may be increased to increase the magnetostriction. As a result, it may be difficult to decrease the coercive force and increase the magnetic permeability of a dust core formed from the amorphous alloy powder. Further, also the saturation magnetic flux density may be decreased.

The content of Mn is preferably 1.3 at % or more and 2.8 at % or less, and more preferably 1.5 at % or more and 2.5 at % or less.

By using Cr and Mn in combination as described above, the above-described effect is exhibited, however, when the content of Cr in the amorphous alloy material is represented by a (at %) and the content of Mn therein is represented by b (at %), the value of (a+b) is preferably 2.1 or more and 5.3 or less, and more preferably 2.5 or more and 5.0 or less. By incorporating Cr and Mn in the amorphous alloy material so as to satisfy this relationship, the effect of the combination use of Cr and Mn is sufficiently exhibited, and also it is possible to prevent a decrease in the saturation magnetic flux density of the amorphous alloy powder. That is, if the value of (a+b) is lower than the above-described lower limit, depending on the composition of the amorphous alloy material, the effect of the combination use of Cr and Mn may not be sufficiently exhibited, and if the value of (a+b) exceeds the above-described upper limit, depending on the composition of the amorphous alloy material, the saturation magnetic flux density of the amorphous alloy powder may be decreased.

The atomic sizes of Cr and Mn are very close to each other as described above, and therefore Cr and Mn can be made to coexist in the amorphous alloy powder in the form of a complete solid solution. However, the characteristic of the amorphous alloy powder can be appropriated adjusted by changing the magnitude relationship between the contents of Cr and Mn. Specifically, when the value of b/a is set to 0.4 or more and less than 1, the content of Cr is relatively larger than that of Mn, and therefore, particularly, the effect of the incorporation of Cr in the amorphous alloy material is strongly exhibited. Accordingly, the corrosion resistance of the amorphous alloy powder is improved, and also the amorphization further proceeds, and thus, the magnetostriction is further decreased. As a result, an amorphous alloy powder having a smaller magnetostriction and higher corrosion resistance is obtained.

When the value of b/a is set to 0.5 or more and less than 0.9, the above-described effect becomes more prominent.

On the other hand, when the value of b/a is set to 1 or more and 2 or less, the content of Mn is relatively larger than that of Cr, and therefore, particularly, the effect of the incorporation of Mn in the amorphous alloy material is strongly exhibited. Accordingly, the magnetostriction of the amorphous alloy powder is further decreased. As a result, an amorphous alloy powder having particularly small magnetostriction is obtained.

When the value of b/a is set to 1.2 or more and 1.5 or less, the above-described effect becomes more prominent.

When the content of Si in the amorphous alloy material is represented by c (at %) and the content of B therein is represented by d (at %), the value of b/(c+d), which shows the ratio of b to the value of (c+d), is preferably 0.04 or more and 0.15 or less, more preferably 0.05 or more and 0.13 or less, and further more preferably 0.06 or more and 0.12 or less. According to this, the decrease in the magnetostriction by the incorporation of Mn in the amorphous alloy material and the increase in the electrical resistance by the incorporation of Si and B therein can be achieved without canceling each other out. As a result, the eddy current loss can be minimized. Further, when the amorphous alloy material is melted, both manganese oxide and silicon oxide are deposited more in a state where the melting point is low, and therefore, the insulating property on the surface of each particle of the amorphous alloy powder can be improved. As a result, an amorphous alloy powder capable of producing a dust core having a high saturation magnetic flux density, a high magnetic permeability, and a small eddy current loss is obtained.

The content of C in the amorphous alloy material is 1 at % or more and 3 at % or less. If the content of C is lower than the above-described lower limit, the viscosity of the amorphous alloy material when it is melted is increased, and the amorphization becomes difficult. Due to this, the electrical resistance of the amorphous alloy material is decreased, and also, the eddy current loss is increased or the magnetostriction is increased, and therefore, it becomes difficult to decrease the coercive force. On the other hand, if the content of C exceeds the above-described upper limit, the amorphization becomes difficult just the same, resulting in increasing the magnetostriction. Further, the saturation magnetic flux density is decreased because the content of Fe is relatively decreased.

The content of C is preferably 1.3 at % or more and 2.7 at % or less, and more preferably 1.5 at % or more and 2.4 at % or less.

C promotes the amorphization in the same manner as Cr described above. However, from the viewpoint of magnetic properties, it is preferred to appropriately adjust the content of C. Specifically, when the content of C is represented by e (at %), the value of (a+e) is preferably 2.2 or more and 5.5 or less, and more preferably 2.5 or more and 5.0 or less. By setting the value of (a+e) within the above-described range, while minimizing the deterioration of the magnetic properties such as the saturation magnetic flux density, the amorphization of the particles of the amorphous alloy powder is reliably promoted and the magnetostriction can be sufficiently decreased.

The value of e/(a+b) is 0.2 or more and 0.95 or less as described above, but is preferably 0.3 or more and 0.9 or less, and more preferably 0.4 or more and 0.85 or less. By setting the contents of Cr, Mn, and C so as to satisfy such a relationship, the amorphization of the amorphous alloy material is particularly promoted and the crystalline magnetic anisotropy thereof is particularly decreased, and therefore, the magnetostriction can be particularly decreased. On the other hand, the decrease in the saturation magnetic flux density can be minimized, and therefore, an amorphous alloy powder capable of producing a dust core, in which both low coercive force and high saturation magnetic flux density are highly achieved, is obtained.

The content of Si in the amorphous alloy material is 10 at % or more and 14 at % or less. If the content of Si is lower than the above-described lower limit, depending on the composition of the amorphous alloy material, the magnetic permeability and the electrical resistance of the amorphous alloy material cannot be sufficiently increased, and thus, the improvement of the magnetic responsiveness to the external magnetic field or the reduction in the eddy current loss may not be able to be sufficiently achieved. On the other hand, if the content of Si exceeds the above-described upper limit, depending on the composition of the amorphous alloy material, the amorphization is inhibited, and also the saturation magnetic flux density is decreased, and thus, both reduction in the iron loss and improvement of the magnetic properties may not be able to be achieved.

The content of Si is preferably 10.3 at % or more and 13.5 at % or less, and more preferably 10.5 at % or more and 13 at % or less.

The content of B in the amorphous alloy material is 8 at % or more and 13 at % or less. If the content of B is lower than the above-described lower limit, depending on the composition of the amorphous alloy material, the melting point of the amorphous alloy material cannot be sufficiently decreased, and therefore, the amorphization may be difficult. On the other hand, if the content of B exceeds the above-described upper limit, depending on the composition of the amorphous alloy material, the saturation magnetic flux density is decreased, and therefore, both reduction in the iron loss and improvement of the magnetic properties may not be able to be achieved.

The content of B is preferably 8.3 at % or more and 12 at % or less, and more preferably 8.5 at % or more and 11.5 at % or less.

When the content of Si in the amorphous alloy material is represented by c (at %) and the content of B therein is represented by d (at %), the value of (a+b)/(c+d+e) is preferably 0.09 or more and 0.27 or less, more preferably 0.12 or more and 0.25 or less, and further more preferably 0.15 or more and 0.23 or less. By incorporating the respective elements in the amorphous alloy material so as to satisfy this relationship, the amorphization of the amorphous alloy material and the reduction in the size of the particles of the amorphous alloy powder can be promoted while reducing the addition amounts of the elements other than Fe as much as possible. As a result, an amorphous alloy powder having a high saturation magnetic flux density and a small magnetostriction can be more reliably obtained.

Also in the amorphous alloy powder of this embodiment, Fe is a component whose content (atomic ratio) is the highest in the amorphous alloy material, that is, it is the main component and has a great influence on the basic magnetic properties and mechanical properties of the amorphous alloy powder.

Third Embodiment of Amorphous Alloy Powder

Next, a third embodiment of the amorphous alloy powder will be described.

Hereinafter, with respect to the amorphous alloy powder of this embodiment, different points from the above-described amorphous alloy powders of the first and second embodiments will be mainly described, and the description of the same matter will be omitted.

The amorphous alloy powder of this embodiment is composed of an amorphous alloy material which contains Fe as a main component, and has a Cr content of 2 at % or more and 3 at % or less, an Mn content of 0.02 at % or more and less than 1 at %, an Si content of 10 at % or more and 14 at % or less, a B content of 8 at % or more and 13 at % or less, and a C content of 1 at % or more and 3 at % or less. Further, when the content of Cr in the amorphous alloy material is represented by a (at %), the content of Mn therein is represented by b (at %), and the content of C therein is represented by e (at %), the value of e/(a+b) is 0.3 or more and 0.95 or less.

Such an amorphous alloy powder has a small magnetostriction by the incorporation of appropriate amounts of Cr and Mn, and also carefully selecting the ratio of the respective elements. Accordingly, by using this amorphous alloy powder, a dust core having a small magnetostriction can be obtained. Such a dust core has both low coercive force and high magnetic permeability, and therefore, the iron loss is small even at a high frequency, and thus, a dust core having favorable magnetic responsiveness even at a high frequency is obtained.

Further, by particularly setting each of the contents of Cr, Mn, and C within the above-described range, the above-described decrease in the magnetostriction can be achieved while reducing the contents of the elements other than Fe to a minimum. Accordingly, the decrease in the saturation magnetic flux density is minimized while decreasing the magnetostriction to a low level, and therefore, an amorphous alloy powder having a particularly low coercive force and a particularly high saturation magnetic flux density is obtained.

Hereinafter, the amorphous alloy powder of this embodiment will be described in more detail.

The content of Cr in the amorphous alloy material constituting the amorphous alloy powder is 2 at % or more and at % or less. If the content of Cr is lower than the above-described lower limit, depending on the composition of the amorphous alloy material, the decrease in the magnetostriction is insufficient, and therefore, a decrease in the coercive force and an increase in the magnetic permeability of a dust core formed from the amorphous alloy powder may not be able to be achieved. Further, the corrosion resistance is deteriorated, and for example, rust may be caused on a surface of a particle of the amorphous alloy powder to deteriorate the magnetic properties such as the saturation magnetic flux density over time. On the other hand, if the content of Cr exceeds the above-described upper limit, depending on the composition of the amorphous alloy material, the amorphization of the amorphous alloy material is inhibited, and therefore, the crystalline magnetic anisotropy thereof may be increased to increase the magnetostriction. As a result, it may be difficult to decrease the coercive force and increase the magnetic permeability of a dust core formed from the amorphous alloy powder. Further, also the saturation magnetic flux density may be decreased.

The content of Cr is preferably 2.1 at % or more and 2.9 at % or less, and more preferably 2.2 at % or more and 2.8 at % or less.

The content of Mn in the amorphous alloy material is 0.02 at % or more and less than 1 at %. If the content of Mn is lower than the above-described lower limit, depending on the composition of the amorphous alloy material, it is difficult to decrease the magnetostriction and also difficult to decrease the coercive force, and therefore, a decrease in the iron loss and an increase in the magnetic permeability may not be able to be achieved. On the other hand, if the content of Mn exceeds the above-described upper limit, depending on the composition of the amorphous alloy material, the saturation magnetic flux density may be decreased because the content of Fe is relatively decreased.

The content of Mn is preferably 0.10 at % or more and 0.95 at % or less, and more preferably 0.20 at % or more and 0.90 at % or less.

By using Cr and Mn in combination as described above, the above-described effect is exhibited, however, when the content of Cr is represented by a (at %) and the content of Mn is represented by b (at %), the value of (a+b) is preferably 2.1 or more and 3.8 or less, and more preferably 2.5 or more and 3.5 or less. By incorporating Cr and Mn in the amorphous alloy material so as to satisfy this relationship, the effect of the combination use of Cr and Mn is sufficiently exhibited, and also it is possible to prevent a decrease in the saturation magnetic flux density. If the value of (a+b) is lower than the above-described lower limit, depending on the composition of the amorphous alloy material, the effect of the combination use of Cr and Mn may not be sufficiently exhibited. On the other hand, if the value of (a+b) exceeds the above-described upper limit, depending on the composition of the amorphous alloy material, the saturation magnetic flux density may be somewhat decreased.

The atomic sizes of Cr and Mn are very close to each other as described above, and therefore Cr and Mn can be made to coexist in the amorphous alloy powder in the form of a complete solid solution. However, the characteristic of the amorphous alloy powder can be appropriated adjusted by changing the magnitude relationship between the contents of Cr and Mn. Specifically, when the value of b/a is set to 0.02 or more and less than 0.47, the effect of the combination use as described above becomes more prominent. That is, the decrease in the coercive force and the increase in the magnetic permeability can be further enhanced. If the value of b/a is lower than the above-described lower limit, depending on the composition of the amorphous alloy material, the effect of the combination use of Cr and Mn may not be exhibited. On the other hand, if the value of b/a exceeds the above-described upper limit, the content of Cr or Mn may deviate from an appropriate range, and therefore, the effect exhibited by each element may not be obtained.

Further, when the value of b/a is set to 0.05 or more and less than 0.40, the above-described effect becomes more prominent.

When the content of Si is represented by c (at %) and the content of B is represented by d (at %), the value of b/(c+d) which shows the ratio of b to the value of c+d is preferably 0.01 or more and 0.05 or less, and more preferably 0.02 or more and 0.04 or less. According to this, the decrease in the magnetostriction by the incorporation of Mn in the amorphous alloy material and the increase in the electrical resistance by the incorporation of Si and B therein can be achieved without significantly decreasing the saturation magnetic flux density. As a result, while maintaining the saturation magnetic flux density at a relatively high level, the decrease in the coercive force and the minimization of the eddy current loss, that is, the reduction in the iron loss can be achieved.

The content of C in the amorphous alloy material is 1 at % or more and 3 at % or less. If the content of C is lower than the above-described lower limit, the viscosity of the amorphous alloy material when it is melted is increased, and the amorphization becomes difficult. Due to this, the electrical resistance of the amorphous alloy material is decreased, and also, the eddy current loss is increased or the magnetostriction is increased, and therefore, it becomes difficult to decrease the coercive force. On the other hand, if the content of C exceeds the above-described upper limit, the amorphization becomes difficult just the same, resulting in increasing the magnetostriction. Further, the saturation magnetic flux density is decreased because the content of Fe is relatively decreased.

The content of C is preferably 1.3 at % or more and 2.7 at % or less, and more preferably 1.5 at % or more and 2.4 at % or less.

C promotes the amorphization in the same manner as Cr described above. However, from the viewpoint of magnetic properties, it is preferred to appropriately adjust the content of C. Specifically, when the content of C is represented by e (at %), the value of (a+e) is preferably 2.2 or more and 5.5 or less, and more preferably 2.5 or more and 5.0 or less. By setting the value of (a+e) within the above-described range, while minimizing the deterioration of the magnetic properties such as the saturation magnetic flux density, the amorphization of the particles of the amorphous alloy powder is reliably promoted and the magnetostriction can be sufficiently decreased.

As described above, the value of e/(a+b) is 0.3 or more and 0.95 or less as described above, but is preferably 0.35 or more and 0.9 or less, and more preferably 0.4 or more and 0.85 or less. By setting the contents of Cr, Mn, and C so as to satisfy such a relationship, the amorphization of the amorphous alloy material is particularly promoted and the crystalline magnetic anisotropy thereof is particularly decreased, and therefore, the magnetostriction can be particularly decreased. On the other hand, the decrease in the saturation magnetic flux density can be minimized, and therefore, an amorphous alloy powder capable of producing a dust core, in which both low coercive force and high saturation magnetic flux density are highly achieved, is obtained.

The content of Si in the amorphous alloy material is 10 at % or more and 14 at % or less. If the content of Si is lower than the above-described lower limit, depending on the composition of the amorphous alloy material, the magnetic permeability and the electrical resistance of the amorphous alloy material cannot be sufficiently increased, and thus, the improvement of the magnetic responsiveness to the external magnetic field or the reduction in the eddy current loss may not be able to be sufficiently achieved. On the other hand, if the content of Si exceeds the above-described upper limit, depending on the composition of the amorphous alloy material, the amorphization is inhibited, and also the saturation magnetic flux density is decreased, and thus, both reduction in the iron loss and improvement of the magnetic properties may not be able to be achieved.

The content of Si is preferably 10.3 at % or more and 13.5 at % or less, and more preferably 10.5 at % or more and 13 at % or less.

The content of B in the amorphous alloy material is 8 at % or more and 13 at % or less. If the content of B is lower than the above-described lower limit, depending on the composition of the amorphous alloy material, the melting point of the amorphous alloy material cannot be sufficiently decreased, and therefore, the amorphization may be difficult. On the other hand, if the content of B exceeds the above-described upper limit, depending on the composition of the amorphous alloy material, the saturation magnetic flux density is decreased, and therefore, both reduction in the iron loss and improvement of the magnetic properties may not be able to be achieved.

The content of B is preferably 8.3 at % or more and 12 at % or less, and more preferably 8.8 at % or more and 11.5 at % or less.

When the content of Si in the amorphous alloy material is represented by c (at %) and the content of B therein is represented by d (at %), the value of (a+b)/(c+d+e) is preferably 0.09 or more and 0.2 or less, more preferably 0.09 or more and 0.18 or less, and further more preferably 0.1 or more and 0.15 or less. By incorporating the respective elements in the amorphous alloy material so as to satisfy this relationship, the amorphization of the amorphous alloy material and the reduction in the size of the particles of the amorphous alloy powder can be promoted while reducing the contents of the elements other than Fe as much as possible. As a result, an amorphous alloy powder having a high saturation magnetic flux density and a small magnetostriction can be more reliably obtained.

Also in the amorphous alloy powder of this embodiment, Fe is a component whose content (atomic ratio) is the highest in the amorphous alloy material, that is, it is the main component and has a great influence on the basic magnetic properties and mechanical properties of the amorphous alloy powder.

Fourth Embodiment of Amorphous Alloy Powder

Next, a fourth embodiment of the amorphous alloy powder will be described.

Hereinafter, with respect to the amorphous alloy powder of this embodiment, different points from the above-described amorphous alloy powders of the first, second, and third embodiments will be mainly described, and the description of the same matter will be omitted.

The amorphous alloy powder of this embodiment is composed of an amorphous alloy material which contains Fe as a main component, and has an Si content of 10 at % or more and 14 at % or less, a B content of 8 at % or more and 13 at % or less, and a C content of 1 at % or more and 3 at % or less. Further, when the content of Cr in the amorphous alloy material is represented by a (at %) and the content of Mn therein is represented by b (at %), the value of (a+b) is 1.5 or more and 5.5 or less, and the value of b/a is 0.3 or more and less than 1.

Such an amorphous alloy powder has a small magnetostriction by the incorporation of appropriate amounts of Cr and Mn, and also carefully selecting the ratio of the respective elements. Accordingly, by using this amorphous alloy powder, a dust core having a small magnetostriction can be obtained. Such a dust core has both low coercive force and high magnetic permeability, and therefore, the iron loss is small even at a high frequency, and thus, a dust core having favorable magnetic responsiveness even at a high frequency is obtained.

Further, by particularly setting the contents of Cr and Mn so as to satisfy the above-described conditions, very high corrosion resistance is obtained, and also the above-described decrease in the magnetostriction can be achieved while reducing the contents of the elements other than Fe to a minimum. Accordingly, an amorphous alloy powder capable of producing a dust core, which achieves both high magnetic permeability and small iron loss, and also has a high saturation magnetic flux density, is obtained.

Hereinafter, the amorphous alloy powder of this embodiment will be described in more detail.

The content of Cr in the amorphous alloy material constituting the amorphous alloy powder is preferably 1 at % or more and 3 at % or less, more preferably 1.05 at % or more and 2.7 at % or less, and further more preferably 1.1 at % or more and 2.5 at % or less. By setting the content of Cr within the above-described range, an amorphous alloy powder having sufficiently high corrosion resistance is obtained, and also an amorphous alloy powder capable of producing a dust core having a sufficiently small iron loss is obtained. If the content of Cr is lower than the above-described lower limit, depending on the composition of the amorphous alloy material, the thickness of a passive film formed on the amorphous alloy powder or an area where such a passive film is formed is insufficient, and thus, the corrosion resistance is deteriorated and also the saturation magnetic flux density may be decreased. On the other hand, if the content of Cr exceeds the above-described upper limit, depending on the composition of the amorphous alloy material, the amorphization of the amorphous alloy material is inhibited, and thus, the electrical resistance is decreased and also the coercive force is increased, and therefore, the iron loss of a dust core formed from the amorphous alloy powder may be increased. Further, the saturation magnetic flux density may be decreased because the content of Fe is relatively decreased.

The content of Mn in the amorphous alloy material is preferably 0.1 at % or more and 2.5 at % or less, more preferably 0.5 at % or more and 2.2 at % or less, and further more preferably 0.7 at % or more and 2.0 at % or less. If the content of Mn is lower than the above-described lower limit, depending on the composition of the amorphous alloy material, it is difficult to decrease the magnetostriction, and therefore, a decrease in the iron loss and an increase in the magnetic permeability may not be able to be achieved. On the other hand, if the content of Mn exceeds the above-described upper limit, depending on the composition of the amorphous alloy material, the saturation magnetic flux density may be decreased because the content of Fe is relatively decreased.

By using Cr and Mn in combination as described above, the above-described effect is exhibited, however, when the content of Cr in the amorphous alloy material is represented by a (at %) and the content of Mn therein is represented by b (at %), the value of (a+b) is 1.5 or more and 5.5 or less. By incorporating Cr and Mn in the amorphous alloy material so as to satisfy this relationship, the effect of the combination use of Cr and Mn is sufficiently exhibited, and also it is possible to prevent a decrease in the saturation magnetic flux density. If the value of (a+b) is lower than the above-described lower limit, depending on the composition of the amorphous alloy material, the effect of the combination use of Cr and Mn may not be sufficiently exhibited. On the other hand, if the value of (a+b) exceeds the above-described upper limit, the saturation magnetic flux density may be decreased.

The value of (a+b) is preferably 1.7 or more and 5 or less, and more preferably 2 or more and 4.5 or less.

The atomic sizes of Cr and Mn are very close to each other as described above, and therefore Cr and Mn can be made to coexist in the amorphous alloy powder in the form of a complete solid solution. However, the characteristic of the amorphous alloy powder can be appropriated adjusted by changing the magnitude relationship between the contents of Cr and Mn.

Specifically, the contents of Cr and Mn are adjusted so that the value of b/a is 0.3 or more and less than 1. By incorporating Cr and Mn in the amorphous alloy material so as to satisfy this relationship, the effect of the combination use as described above becomes more prominent. That is, while particularly enhancing the corrosion resistance and the amorphization by the incorporation of Cr in the amorphous alloy material, the coercive force can be decreased by the incorporation of Mn in the amorphous alloy material, and the decrease in the coercive force and the increase in the magnetic permeability can be further enhanced. If the value of b/a is lower than the above-described lower limit, depending on the composition of the amorphous alloy material, the effect of the combination use of Cr and Mn may not be exhibited. On the other hand, if the value of b/a exceeds the above-described upper limit, the content of Cr or Mn may deviate from an appropriate range, and therefore, the effect exhibited by each element (Cr or Mn) may not be obtained.

The value of b/a is preferably 0.4 or more and less than 0.9.

The content of C in the amorphous alloy material is 1 at % or more and 3 at % or less. If the content of C is lower than the above-described lower limit, the viscosity of the amorphous alloy material when it is melted is increased, and the amorphization becomes difficult. Due to this, the electrical resistance of the amorphous alloy material is decreased, and also, the eddy current loss is increased or the magnetostriction is increased, and therefore, it becomes difficult to decrease the coercive force. On the other hand, if the content of C exceeds the above-described upper limit, the amorphization becomes difficult just the same, resulting in increasing the magnetostriction. Further, the saturation magnetic flux density is decreased because the content of Fe is relatively decreased.

The content of C is preferably 1.3 at % or more and 2.7 at % or less, and more preferably 1.5 at % or more and 2.4 at % or less.

C promotes the amorphization in the same manner as Cr described above. However, from the viewpoint of magnetic properties, it is preferred to appropriately adjust the content of C. Specifically, when the content of C is represented by e (at %), the value of (a+e) is preferably 2.2 or more and 5.5 or less, and more preferably 2.5 or more and 5.0 or less. By setting the value of (a+e) within the above-described range, while minimizing the deterioration of the magnetic properties such as the saturation magnetic flux density, the amorphization of the particles of the amorphous alloy powder is reliably promoted and the magnetostriction can be sufficiently decreased.

The value of e/(a+b) is preferably 0.3 or more and 1 or less, more preferably 0.35 or more and 0.9 or less, and further more preferably 0.4 or more and 0.85 or less. By setting the contents of Cr, Mn, and C so as to satisfy such a relationship, the amorphization of the amorphous alloy material is particularly promoted and the crystalline magnetic anisotropy thereof is particularly decreased, and therefore, the magnetostriction can be particularly decreased. On the other hand, the decrease in the saturation magnetic flux density can be minimized, and therefore, an amorphous alloy powder capable of producing a dust core, in which both low coercive force and high saturation magnetic flux density are highly achieved, is obtained.

The content of Si in the amorphous alloy material is 10 at % or more and 14 at % or less. If the content of Si is lower than the above-described lower limit, depending on the composition of the amorphous alloy material, the magnetic permeability and the electrical resistance of the amorphous alloy material cannot be sufficiently increased, and thus, the improvement of the magnetic responsiveness to the external magnetic field or the reduction in the eddy current loss may not be able to be sufficiently achieved. On the other hand, if the content of Si exceeds the above-described upper limit, depending on the composition of the amorphous alloy material, the amorphization is inhibited, and also the saturation magnetic flux density is decreased, and thus, both reduction in the iron loss and improvement of the magnetic properties may not be able to be achieved.

The content of Si is preferably 10.3 at % or more and 13.5 at % or less, and more preferably 10.5 at % or more and 13 at % or less.

The content of B in the amorphous alloy material is 8 at % or more and 13 at % or less. If the content of B is lower than the above-described lower limit, depending on the composition of the amorphous alloy material, the melting point of the amorphous alloy material cannot be sufficiently decreased, and therefore, the amorphization may be difficult. On the other hand, if the content of B exceeds the above-described upper limit, depending on the composition of the amorphous alloy material, the saturation magnetic flux density is decreased, and therefore, both reduction in the iron loss and improvement of the magnetic properties may not be able to be achieved.

The content of B is preferably 8.3 at % or more and 12 at % or less, and more preferably 8.8 at % or more and 11.5 at % or less.

When the content of Si in the amorphous alloy material is represented by c (at %) and the content of B therein is represented by d (at %), the value of (a+b)/(c+d+e) is preferably 0.05 or more and 0.25 or less, more preferably 0.07 or more and 0.23 or less, and further more preferably 0.09 or more and 0.2 or less. By incorporating the respective elements in the amorphous alloy material so as to satisfy this relationship, the amorphization of the amorphous alloy material and the reduction in the size of the particles of the amorphous alloy powder can be promoted while reducing the contents of the elements other than Fe as much as possible. As a result, an amorphous alloy powder having a high saturation magnetic flux density and a small magnetostriction can be more reliably obtained.

The value of b/(c+d) is preferably 0.01 or more and 0.12 or less, more preferably 0.03 or more and 0.11 or less, and further more preferably 0.05 or more and 0.10 or less. By incorporating the respective elements in the amorphous alloy material so as to satisfy this relationship, an amorphous alloy powder, in which the achievement of the decrease in the magnetostriction and the amorphization is further enhanced, is obtained. If the value of b/(c+d) is lower than the above-described lower limit, depending on the composition of the amorphous alloy material, the magnetostriction of the amorphous alloy powder may not be able to be sufficiently decreased. On the other hand, if the value of b/(c+d) exceeds the above-described upper limit, depending on the composition of the amorphous alloy material, the amorphization of the amorphous alloy material is insufficient, and therefore, it may be difficult to decrease the magnetostriction.

Also in the amorphous alloy powder of this embodiment, Fe is a component whose content (atomic ratio) is the highest in the amorphous alloy material, that is, it is the main component and has a great influence on the basic magnetic properties and mechanical properties of the amorphous alloy powder.

Fifth Embodiment of Amorphous Alloy Powder

Next, a fifth embodiment of the amorphous alloy powder will be described.

Hereinafter, with respect to the amorphous alloy powder of this embodiment, different points from the above-described amorphous alloy powders of the first, second, third, and fourth embodiments will be mainly described, and the description of the same matter will be omitted.

The amorphous alloy powder of this embodiment is composed of an amorphous alloy material which contains Fe as a main component, and has an Si content of 10 at % or more and 14 at % or less, a B content of 8 at % or more and 13 at % or less, and a C content of 1 at % or more and 3 at % or less. Further, when the content of Cr in the amorphous alloy material is represented by a (at %) and the content of Mn therein is represented by b (at %), the value of (a+b) is 1.5 or more and 6 or less, and the value of b/a is 1 or more and 2 or less.

Such an amorphous alloy powder has a small magnetostriction by the incorporation of appropriate amounts of Cr and Mn. Accordingly, by using this amorphous alloy powder, a dust core having a small magnetostriction can be obtained. Such a dust core has both low coercive force and high magnetic permeability, and therefore, the iron loss is small even at a high frequency, and thus, a dust core having favorable magnetic responsiveness even at a high frequency is obtained.

Further, by particularly setting each of the contents of Cr and Mn within the above-described range, the above-described decrease in the magnetostriction can be achieved while reducing the contents of the elements other than Fe to a minimum. Accordingly, an amorphous alloy powder capable of producing a dust core, which achieves both high magnetic permeability and small iron loss, and also has a high saturation magnetic flux density, is obtained.

Hereinafter, the amorphous alloy powder of this embodiment will be described in more detail.

The content of Cr in the amorphous alloy material constituting the amorphous alloy powder is preferably 1 at % or more and 3 at % or less, more preferably 1.05 at % or more and 2.7 at % or less, and further more preferably 1.1 at % or more and 2.5 at % or less. By setting the content of Cr within the above-described range, an amorphous alloy powder having sufficiently high corrosion resistance is obtained, and also an amorphous alloy powder capable of producing a dust core having a sufficiently small iron loss is obtained. If the content of Cr is lower than the above-described lower limit, depending on the composition of the amorphous alloy material, the thickness of a passive film formed on the amorphous alloy powder or an area where such a passive film is formed is insufficient, and thus, the corrosion resistance is decreased and also the saturation magnetic flux density may be decreased. On the other hand, if the content of Cr exceeds the above-described upper limit, depending on the composition of the amorphous alloy material, the amorphization of the amorphous alloy material is inhibited, and thus, the electrical resistance is decreased and also the coercive force is increased, and therefore, the iron loss of a dust core formed from the amorphous alloy powder may be increased. Further, the saturation magnetic flux density may be decreased because the content of Fe is relatively decreased.

The content of Mn in the amorphous alloy material is preferably 0.5 at % or more and 3 at % or less, more preferably 0.7 at % or more and 2.7 at % or less, and further more preferably 1.0 at % or more and 2.5 at % or less. If the content of Mn is lower than the above-described lower limit, depending on the composition of the amorphous alloy material, it is difficult to decrease the magnetostriction, and therefore, a decrease in the iron loss and an increase in the magnetic permeability may not be able to be achieved. On the other hand, if the content of Mn exceeds the above-described upper limit, depending on the composition of the amorphous alloy material, the saturation magnetic flux density may be decreased because the content of Fe is relatively decreased.

By using Cr and Mn in combination as described above, the above-described effect is exhibited, however, when the content of Cr in the amorphous alloy material is represented by a (at %) and the content of Mn therein is represented by b (at %), the value of (a+b) is 1.5 or more and 6 or less. By incorporating Cr and Mn in the amorphous alloy material so as to satisfy this relationship, the effect of the combination use of Cr and Mn is sufficiently exhibited, and also it is possible to prevent a decrease in the saturation magnetic flux density. If the value of (a+b) is lower than the above-described lower limit, depending on the composition of the amorphous alloy material, the effect of the combination use of Cr and Mn is not sufficiently exhibited. On the other hand, if the value of (a+b) exceeds the above-described upper limit, the saturation magnetic flux density is decreased.

The value of (a+b) is preferably 1.7 or more and 5 or less, and more preferably 2 or more and 4.5 or less.

The atomic sizes of Cr and Mn are very close to each other as described above, and therefore Cr and Mn can be made to coexist in the amorphous alloy powder in the form of a complete solid solution. However, the characteristic of the amorphous alloy powder can be appropriated adjusted by changing the magnitude relationship between the contents of Cr and Mn.

Specifically, the contents of Cr and Mn are adjusted so that the value of b/a is 1 or more and 2 or less. By incorporating Cr and Mn in the amorphous alloy material so as to satisfy this relationship, the effect of the combination use as described above becomes more prominent. That is, while particularly decreasing the coercive force by the incorporation of Mn in the amorphous alloy material, the corrosion resistance and the amorphization can be enhanced by the incorporation of Cr therein, and the decrease in the coercive force and the increase in the magnetic permeability can be further enhanced. If the value of b/a is lower than the above-described lower limit, depending on the composition of the amorphous alloy material, the effect of the combination use of Cr and Mn may not be exhibited. On the other hand, if the value of b/a exceeds the above-described upper limit, the content of Cr or Mn may deviate from an appropriate range, and therefore, the effect exhibited by each element (Cr or Mn) may not be obtained.

The value of b/a is preferably 1.1 or more and 1.9 or less.

The content of C in the amorphous alloy material is 1 at % or more and 3 at % or less. If the content of C is lower than the above-described lower limit, the viscosity of the amorphous alloy material when it is melted is increased, and the amorphization becomes difficult. Due to this, the electrical resistance of the amorphous alloy material is decreased, and also, the eddy current loss is increased or the magnetostriction is increased, and therefore, it becomes difficult to decrease the coercive force. On the other hand, if the content of C exceeds the above-described upper limit, the amorphization becomes difficult just the same, resulting in increasing the magnetostriction. Further, the saturation magnetic flux density is decreased because the content of Fe is relatively decreased.

The content of C is preferably 1.3 at % or more and 2.7 at % or less, and more preferably 1.5 at % or more and 2.4 at % or less.

C promotes the amorphization in the same manner as Cr described above. However, from the viewpoint of magnetic properties, it is preferred to appropriately adjust the content of C. Specifically, when the content of C is represented by e (at %), the value of (a+e) is preferably 2.2 or more and 5.5 or less, and more preferably 2.5 or more and 5.0 or less. By setting the value of (a+e) within the above-described range, while minimizing the deterioration of the magnetic properties such as the saturation magnetic flux density, the amorphization of the particles of the amorphous alloy powder is reliably promoted and the magnetostriction can be sufficiently decreased.

The value of e/(a+b) is preferably 0.3 or more and 0.95 or less, more preferably 0.35 or more and 0.9 or less, and further more preferably 0.4 or more and 0.85 or less. By setting the contents of Cr, Mn, and C so as to satisfy such a relationship, the amorphization of the amorphous alloy material is particularly promoted and the crystalline magnetic anisotropy thereof is particularly decreased. As a result, the magnetostriction of the amorphous alloy material can be particularly decreased. Meanwhile, the decrease in the saturation magnetic flux density can be minimized, and therefore, an amorphous alloy powder capable of producing a dust core, in which both low coercive force and high saturation magnetic flux density are highly achieved, is obtained.

The content of Si in the amorphous alloy material is 10 at % or more and 14 at % or less. If the content of Si is lower than the above-described lower limit, depending on the composition of the amorphous alloy material, the magnetic permeability and the electrical resistance of the amorphous alloy material cannot be sufficiently increased. Therefore, the improvement of the magnetic responsiveness to the external magnetic field or the reduction in the eddy current loss may not be able to be sufficiently achieved. On the other hand, if the content of Si exceeds the above-described upper limit, depending on the composition of the amorphous alloy material, the amorphization is inhibited, and also the saturation magnetic flux density is decreased, and thus, both reduction in the iron loss and improvement of the magnetic properties may not be able to be achieved.

The content of Si is preferably 10.3 at % or more and 13.5 at % or less, and more preferably 10.5 at % or more and 13 at % or less.

The content of B in the amorphous alloy material is 8 at % or more and 13 at % or less. If the content of B is lower than the above-described lower limit, depending on the composition of the amorphous alloy material, the melting point of the amorphous alloy material cannot be sufficiently decreased, and therefore, the amorphization may be difficult. On the other hand, if the content of B exceeds the above-described upper limit, depending on the composition of the amorphous alloy material, the saturation magnetic flux density is decreased, and therefore, both reduction in the iron loss and improvement of the magnetic properties may not be able to be achieved.

The content of B is preferably 8.3 at % or more and 12 at % or less, and more preferably 8.8 at % or more and 11.5 at % or less.

When the content of Si in the amorphous alloy material is represented by c (at %) and the content of B therein is represented by d (at %), the value of (a+b)/(c+d+e) is preferably 0.05 or more and 0.25 or less, more preferably 0.07 or more and 0.2 or less, and further more preferably 0.09 or more and 0.15 or less. By incorporating the respective elements in the amorphous alloy material so as to satisfy this relationship, the amorphization of the amorphous alloy material and the reduction in the size of the particles of the amorphous alloy powder can be promoted while reducing the contents of the elements other than Fe as much as possible. As a result, an amorphous alloy powder having a high saturation magnetic flux density and a small magnetostriction can be more reliably obtained.

The value of b/(c+d) is preferably 0.03 or more and 0.15 or less, more preferably 0.04 or more and 0.13 or less, and further more preferably 0.05 or more and 0.12 or less. By incorporating the respective elements in the amorphous alloy material so as to satisfy this relationship, an amorphous alloy powder, in which the achievement of the decrease in the magnetostriction and the amorphization is further enhanced, is obtained. If the value of b/(c+d) is lower than the above-described lower limit, depending on the composition of the amorphous alloy material, the magnetostriction of the amorphous alloy powder may not be able to be sufficiently decreased. On the other hand, if the value of b/(c+d) exceeds the above-described upper limit, depending on the composition of the amorphous alloy material, the amorphization of the particles of the amorphous alloy powder is insufficient, and therefore, it may be difficult to decrease the magnetostriction.

Also in the amorphous alloy powder of this embodiment, Fe is a component whose content (atomic ratio) is the highest in the amorphous alloy material, that is, it is the main component and has a great influence on the basic magnetic properties and mechanical properties of the amorphous alloy powder.

The amorphous alloy material may contain elements (impurities) other than Cr, Mn, Si, B, C, and Fe within the range which does not adversely affect the characteristic of the amorphous alloy material. Examples of the other elements include N (nitrogen), P (phosphorus), S (sulfur), Al, Mg, Sc, Ti, V, Co, Ni, Cu, Zn, Ga, Ge, Y, Zr, Nb, Mo, Pd, Ag, In, Sn, Sb, Hf, Ta, W, Os, Ir, Pt, Au, Pb, and Bi. These elements may be intentionally added thereto, or unavoidably mixed therein during the production. In either case, the mixing amount thereof is preferably less than 0.1 at %, and more preferably 0.05 at % or less.

The constituent elements and the compositional ratio of the amorphous alloy material can be determined by, for example, atomic absorption spectroscopy defined in JIS G 1257, ICP emission spectroscopy defined in JIS G 1258, spark emission spectroscopy defined in JIS G 1253, X-ray fluorescence analysis defined in JIS G 1256, gravimetry, titrimetry, and absorption spectroscopy defined in JIS G 1211 to G 1237, or the like. Specifically, an optical emission spectrometer for solids (a spark emission spectrometer) manufactured by SPECTRO Analytical Instruments GmbH (model: Spectrolab, type: LAVMB08A) is used.

When determining C (carbon) and S (sulfur), particularly, an oxygen flow combustion (high-frequency induction furnace combustion) infrared absorption method defined in JIS G 1211 is also used. Specifically, a carbon/sulfur analyzer CS-200 manufactured by LECO Corporation is used.

When determining N (nitrogen) and O (oxygen), particularly, a method for determination of nitrogen in iron and steel defined in JIS G 1228, or a method for determination of oxygen in metal materials defined in JIS Z 2613 is also used. Specifically, an oxygen/nitrogen analyzer TC-300/EF-300 manufactured by LECO Corporation is used.

It can be determined whether the amorphous alloy material constituting the amorphous alloy powder is amorphous or not from a spectrum obtained by, for example, X-ray diffractometry. Specifically, in the case where a clear diffraction peak is not observed in an X-ray diffraction spectrum, it can be determined that the test substance is amorphous.

The average particle diameter of the particles of the amorphous alloy powder is preferably 3 μm or more and 100 μm or less, more preferably 4 μm or more and 80 μm or less, and further more preferably 5 μm or more and 60 μm or less. In a dust core produced using the amorphous alloy powder composed of particles having a particle diameter within this range, a path through which an eddy current flows can be shortened, and therefore, a dust core in which the eddy current loss is sufficiently reduced can be obtained.

The average particle diameter of the particles may be obtained by laser diffractometry as a particle diameter when the cumulative amount by mass is 50%.

If the average particle diameter of the particles of the amorphous alloy powder is lower than the above-described lower limit, the moldability when press-molding the amorphous alloy powder is deteriorated, and therefore, the density of the dust core to be obtained is decreased, and the saturation magnetic flux density or the magnetic permeability may be decreased. On the other hand, if the average particle diameter of the particles of the amorphous alloy powder exceeds the above-described upper limit, the length of a path through which an eddy current flows is increased in the dust core, and therefore, the eddy current loss may be increased.

The particle size distribution of the particles of the amorphous alloy powder is preferably as narrow as possible. Specifically, if the average particle diameter of the particles of the amorphous alloy powder is within the above-described range, the maximum particle diameter is preferably 200 μm or less, and more preferably 150 μm or less. By controlling the maximum particle diameter of the particles of the amorphous alloy powder, the particle size distribution of the particles of the amorphous alloy powder can be made narrower, and a problem that the eddy current loss is locally increased, and the like is solved.

Here, the "maximum particle diameter" refers to a particle diameter when the cumulative amount by mass is 99.9%.

The average of the aspect ratios of the particles of the amorphous alloy powder defined by S/L wherein S (μm) represents the minor axis of each particle, and L (μm) represents the major axis thereof is preferably about 0.4 or more and 1 or less, and more preferably about 0.7 or more and 1 or less. The amorphous alloy powder having an aspect ratio within this range has a shape relatively close to a spherical shape, and therefore, the packing ratio when molding the powder is increased. As a result, a dust core having a high saturation magnetic flux density and a high magnetic permeability can be obtained.

Here, the "major axis" is the longest diameter in the projected image of the particle, and the "minor axis" is the longest diameter in the direction perpendicular to the major axis.

The amorphous alloy powder has a Vickers hardness in a cross-sectional central region of each particle of preferably 850 or more and 1200 or less, and more preferably 900 or more and 1000 or less. The amorphous alloy powder composed of particles having a hardness within this range contributes to the increase in the packing ability of the amorphous alloy powder because the powder has a high hardness but is plastically deformable to a small extent during molding. If the Vickers hardness is lower than the above-described lower limit, the particles are easily deformed, and therefore, although the packing ability is increased, when an insulating film is formed on the surface of each particle, the insulating film may be torn accompanying the deformation of the particle. As a result, the eddy current loss may be increased. On the other hand, if the Vickers hardness exceeds the above-described upper limit, the particles are hardly plastically deformed during molding, and therefore, the packing ability of the amorphous alloy powder may be decreased.

Here, the "cross-sectional central region of each particle" refers to a region at the center of the major axis of a section obtained by cutting the particle along the major axis which is the longest diameter of the particle. Further, the Vickers hardness in the central region can be measured by a Micro Vickers hardness tester.

The apparent density of the amorphous alloy powder is preferably 3 g/cm$^3$ or more, and more preferably 3.5 g/cm$^3$ or more. In the case where a dust core is produced using the amorphous alloy powder having a high apparent density in this manner, since the packing ratio of the particles is high, a dust core having a particularly high density is obtained. As a result, a dust core whose magnetic permeability and saturation magnetic flux density are particularly high is obtained.

The apparent density is defined as a value obtained by measurement using a method defined in JIS Z 2504.

Since the amorphous alloy powder has an alloy composition as described above, the coercive force of the amorphous alloy powder can be decreased. Specifically, the coercive force of the amorphous alloy powder is preferably 4 Oe (318 A/m) or less, and more preferably 1.5 Oe (119 A/m) or less. By decreasing the coercive force to fall within this range, the hysteresis loss can be reliably decreased, and therefore, the iron loss can be sufficiently decreased.

The saturation magnetic flux density of the amorphous alloy powder may be as high as possible, but is preferably 0.8 T or more, and more preferably 1.0 T or more. When the saturation magnetic flux density of the amorphous alloy powder is within the above-described range, the size of the dust core formed from the amorphous alloy powder can be decreased without deteriorating the performance.

Further, the particles of the amorphous alloy powder may contain a small amount of oxygen. In this case, the oxygen content in the particles is preferably 150 ppm by mass or more and 3000 ppm by mass or less, more preferably 200 ppm by mass or more and 2500 ppm by mass or less, and further more preferably 200 ppm by mass or more and 1500 ppm by mass or less. By decreasing the oxygen content in the particles to fall within the above range, an amorphous alloy powder, in which small iron loss, high saturation magnetic flux density, and weather resistance are highly achieved, can be obtained. If the oxygen content in the particles is lower than the above-described lower limit, depending on the particle diameters of the particles of the amorphous alloy powder, an oxide film having a suitable thickness is not formed on the particles of the amorphous alloy powder, and so on, and therefore, the insulating property between particles of the amorphous alloy powder is decreased, and thus, the iron loss may be increased or the weather resistance may be decreased. On the other hand, if the oxygen content exceeds the above-described upper limit, the thickness of the oxide film is increased too much, and the saturation magnetic flux density or the like may be decreased by the increment of the thickness.

The amorphous alloy powder as described above is produced by any of a variety of powdering methods such as an atomization method (such as a water atomization method, a gas atomization method, or a high-speed spinning water atomization method), a reducing method, a carbonyl method, and a pulverization method.

The amorphous alloy powder is preferably produced by an atomization method among these methods, and more preferably produced by a water atomization method or a high-speed spinning water atomization method. The atomization method is a method in which a molten metal is caused to collide with a fluid (a liquid or a gas) sprayed at a high speed to atomize the molten metal, followed by cooling, whereby a metal powder (an amorphous alloy powder) is produced. By producing the amorphous alloy powder through such an atomization method, an extremely fine powder can be efficiently produced. Further, the shape of the particle of the obtained powder is closer to a spherical shape by the action of surface tension. Due to this, a dust core having a high packing ratio can be produced using this amorphous alloy powder. Accordingly, an amorphous alloy powder capable of producing a dust core having a high magnetic permeability and a high saturation magnetic flux density can be obtained.

In the case where a water atomization method is used as the atomization method, the pressure of water to be sprayed to the molten metal (hereinafter referred to as "atomization water") is not particularly limited, but is preferably about 75 MPa or more and 120 MPa or less (750 kgf/cm$^2$ or more and 1200 kgf/cm$^2$ or less), and more preferably about 90 MPa or more and 120 MPa or less (900 kgf/cm$^2$ or more and 1200 kgf/cm$^2$ or less).

The temperature of the atomization water is also not particularly limited, but is preferably about 1° C. or higher and 20° C. or lower.

The atomization water is often sprayed in a cone shape such that it has a vertex on the fall path of the molten metal and the outer diameter gradually decreases downward. In this case, the vertex angle θ of the cone formed by the atomization water is preferably about 10° or more and 40° or less, and more preferably about 15° or more and 35° or less. According to this, an amorphous alloy powder having a composition as described above can be reliably produced.

Further, by using a water atomization method (particularly, a high-speed spinning water atomization method), the molten metal can be particularly quickly cooled. Due to this, an amorphous alloy powder having a high degree of amorphization over a wide alloy composition range is obtained.

The cooling rate when cooling the molten metal in the atomization method is preferably $1\times10^{4}$° C./s or more, and more preferably $1\times10^{5}$° C./s or more. By the quick cooling in this manner, the molten metal is solidified while maintaining the atomic arrangement in a state of the molten metal, that is, in a state where all sorts of atoms are uniformly mixed with one another, and therefore, an amorphous alloy powder having a particularly high degree of amorphization is obtained. Further, a variation in the compositional ratio among the particles of the amorphous alloy powder is prevented. As a result, an amorphous alloy powder which is homogeneous and has excellent magnetic properties is obtained.

After producing the amorphous alloy powder by the method as described above, the powder may be subjected to an annealing treatment as desired. As for the heating conditions in this annealing treatment, when the heating temperature is equal to or higher than the temperature of Tx-250° C. (wherein Tx represents the crystallization temperature of the amorphous alloy material) and lower than Tx, the heating time is 5 minutes or more and 120 minutes or less, and when the heating temperature is equal to or higher than the temperature of Tx-100° C. (wherein Tx represents the crystallization temperature of the amorphous alloy material) and lower than Tx, the heating time is 10 minutes or more and 60 minutes or less. By performing the annealing treatment under such heating conditions, the amorphous alloy powder (amorphous alloy particles) composed of the amorphous alloy material is annealed, and the residual stress caused by the solidification through quick cooling when producing the powder can be relaxed. Accordingly, the distortion of the amorphous alloy powder accompanying the residual stress is relaxed and the magnetic properties can be improved.

The thus obtained amorphous alloy powder may be classified as desired. Examples of the classification method include dry classification such as sieve classification, inertial classification, and centrifugal classification; and wet classification such as sedimentation classification.

Further, the thus obtained amorphous alloy powder may be granulated as desired.

Further, an insulating film may be formed on the surface of each particle of the thus obtained amorphous alloy powder as desired. As the constituent material of the insulating film, for example, the same material as the constituent material of the below-described binding material may be used.

Dust Core and Magnetic Element

The magnetic element can be applied to a variety of magnetic elements provided with a core such as a choke coil, an inductor, a noise filter, a reactor, a transformer, a motor, and an electric generator. Further, the dust core can be applied to cores provided in these magnetic elements.

Hereinafter, two types of choke coils will be described as representative examples of the magnetic element.

First Embodiment of Magnetic Element

First, a choke coil to which a first embodiment of the magnetic element is applied will be described.

FIG. 1 is a schematic view (a plan view) showing a choke coil to which a first embodiment of the magnetic element is applied.

A choke coil 10 shown in FIG. 1 includes a ring-shaped (toroidal) dust core 11 and a conductive wire 12 wound around the dust core 11. Such a choke coil 10 is generally referred to as "toroidal coil".

The dust core 11 is obtained by mixing the amorphous alloy powder, a binding material (a binder), and an organic solvent, feeding the obtained mixture in a mold, and press-molding the mixture.

Examples of the constituent material of the binding material to be used for producing the dust core 11 include organic materials such as a silicone resin, an epoxy resin, a phenolic resin, a polyamide resin, a polyimide resin, and a polyphenylene sulfide resin; and inorganic materials such as phosphates (such as magnesium phosphate, calcium phosphate, zinc phosphate, manganese phosphate, and cadmium phosphate), and silicates (water glass) (such as sodium silicate), and particularly, a thermosetting polyimide resin or a thermosetting epoxy resin is preferred. These resin materials are easily cured by heating and have excellent heat resistance. Accordingly, the production of the dust core 11 can be facilitated, and also the heat resistance thereof can be enhanced.

The ratio of the binding material to the amorphous alloy powder slightly varies depending on the desired saturation magnetic flux density, the allowable eddy current loss, and the like of the dust core 11 to be produced, but is preferably about 0.5% by mass or more and 5% by mass or less, and more preferably about 1% by mass or more and 3% by mass or less. According to this, the particles of the amorphous alloy powder are reliably insulated from each other, and the density of the dust core 11 is ensured to some extent, and thus, a significant decrease in the saturation magnetic flux density and the magnetic permeability of the dust core 11 can be prevented. As a result, the dust core 11 having a higher saturation magnetic flux density, a higher magnetic permeability, and a smaller loss is provided.

The organic solvent is not particularly limited as long as it can dissolve the binding material, but examples thereof include various solvents such as toluene, isopropyl alcohol, acetone, methyl ethyl ketone, chloroform, and ethyl acetate.

To the above-described mixture, any of a variety of additives may be added for an arbitrary purpose as desired.

Such a binding material binds the particles of the amorphous alloy powder and also insulates the particles from each other. Therefore, even when a magnetic field which changes at a high frequency is applied to the dust core 11, an induced current accompanying an electromotive force generated through the electromagnetic induction caused by the change in the magnetic field flows only in a relatively narrow region in the particles. Accordingly, the Joule loss (an eddy current loss) due to this induced current can be decreased to a low level. Further, since the coercive force of the particles is small, also the hysteresis loss can be decreased to a low level.

Further, the Joule loss causes heat generation in the dust core 11, and therefore, by decreasing the Joule loss, the amount of heat generation in the choke coil 10 can be also decreased.

Examples of the constituent material of the conductive wire 12 include highly conductive materials such as metal materials (such as Cu, Al, Ag, Au, and Ni) and alloys containing such a metal material.

It is preferred that on the surface of the conductive wire 12, an insulating surface layer is provided. According to this, a short circuit between the dust core 11 and the conductive wire 12 can be reliably prevented. Examples of the constituent material of such a surface layer include various resin materials.

Next, a method for producing the choke coil 10 will be described.

First, the amorphous alloy powder, a binding material, all sorts of additives, and an organic solvent are mixed, whereby a mixture is obtained.

Subsequently, the mixture is dried to obtain a dry material in the form of lumps. Then, the thus obtained dry material is pulverized, whereby a granular powder is formed.

Subsequently, this granular powder is molded into a shape of a dust core to be produced, whereby a molded body is obtained.

A molding method in this case is not particularly limited, however, examples thereof include press-molding, extrusion-molding, and injection-molding. The shape and size of this molded body are determined in anticipation of shrinkage when heating the molded body in the subsequent step.

Subsequently, by heating the obtained molded body, the binding material is cured, whereby the dust core 11 is obtained. The heating temperature at this time slightly varies depending on the composition of the binding material and the like, however, in the case where the binding material is composed of an organic material, the heating temperature is set to preferably about 100° C. or higher and 500° C. or lower, and more preferably about 120° C. or higher and 250° C. or lower. The heating time varies depending on the heating temperature, but is set to about 0.5 hours or more and 5 hours or less.

According to the above-described method, the choke coil (the magnetic element) 10 including the dust core 11 obtained by press-molding the amorphous alloy powder and the conductive wire 12 wound around the dust core 11 along the outer peripheral surface thereof is obtained. The thus obtained choke coil 10 has excellent corrosion resistance for a long period of time, and also has a small loss (iron loss) in a high frequency range.

Further, by using the amorphous alloy powder, the dust core 11 having excellent magnetic properties can be easily obtained. Accordingly, the improvement of the saturation magnetic flux density of the dust core 11, and accompanying the improvement, a reduction in the size of the choke coil 10 and an increase in the rated current thereof, and a decrease in the amount of heat generation therein can be easily realized. That is, a high-performance choke coil 10 is obtained.

The shape of the dust core 11 is not limited to the above-described ring shape, and may be, for example, a rod shape, an E-shape, an I-shape, or the like.

Second Embodiment of Magnetic Element

Next, a choke coil to which a second embodiment of the magnetic element is applied will be described.

Figure 2:
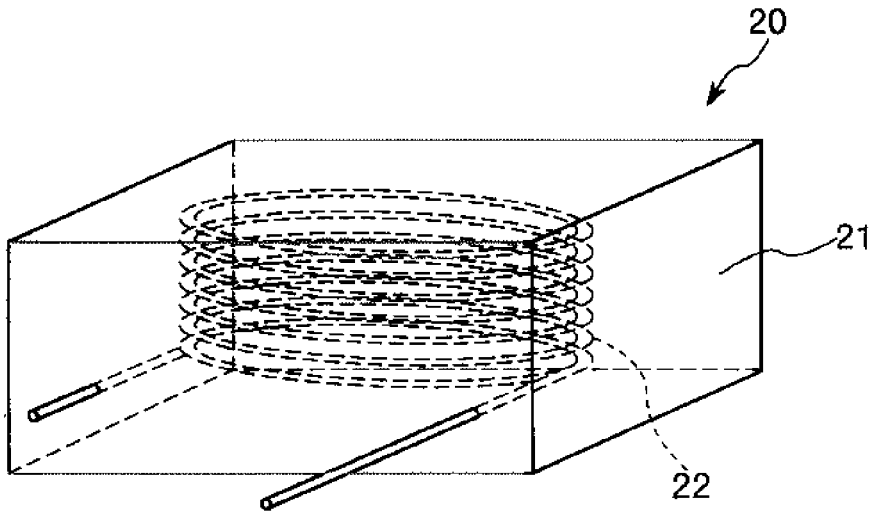
FIG. 2 is a schematic view (a transparent perspective view) showing a choke coil, to which a second embodiment of a magnetic element is applied.

FIG. 2 is a schematic view (a transparent perspective view) showing a choke coil to which a second embodiment of the magnetic element is applied.

Hereinafter, the choke coil according to the second embodiment will be described, however, different points from the choke coil according to the first embodiment described above will be mainly described and the description of the same matter will be omitted.

As shown in FIG. 2, a choke coil 20 according to this embodiment is obtained by embedding a conductive wire 22 molded into a coil shape inside a dust core 21. That is, the choke coil 20 is obtained by molding the conductive wire 22 with the dust core 21.

The reduction in the size of the choke coil 20 having such a configuration is relatively easy. By using the dust core 21 having a high saturation magnetic flux density, a high magnetic permeability, and a small loss when producing such a small choke coil 20, the choke coil 20 which has a low loss and generates low heat so as to be able to cope with a high current although its size is small is obtained.

Since the conductive wire 22 is embedded inside the dust core 21, a gap is hardly formed between the conductive wire 22 and the dust core 21. Accordingly, vibration caused by the magnetostriction of the dust core 21 is suppressed, and the occurrence of noise accompanying this vibration can be also suppressed.

In the case where the choke coil 20 according to this embodiment as described above is produced, first, the conductive wire 22 is disposed in the cavity of a mold, and also the amorphous alloy powder is packed in the cavity. More specifically, the amorphous alloy powder is packed therein so that the conductive wire 22 is embedded therein.

Subsequently, the amorphous alloy powder is compressed together with the conductive wire 22, whereby a molded body is obtained.

Then, in the same manner as the above-described magnetic element of the first embodiment, the obtained molded body is subjected to a heat treatment. By doing this, the choke coil 20 is obtained.

Electronic Device

Next, an electronic device including the magnetic element will be described with reference to FIGS. 3 to 5.

Figure 3:
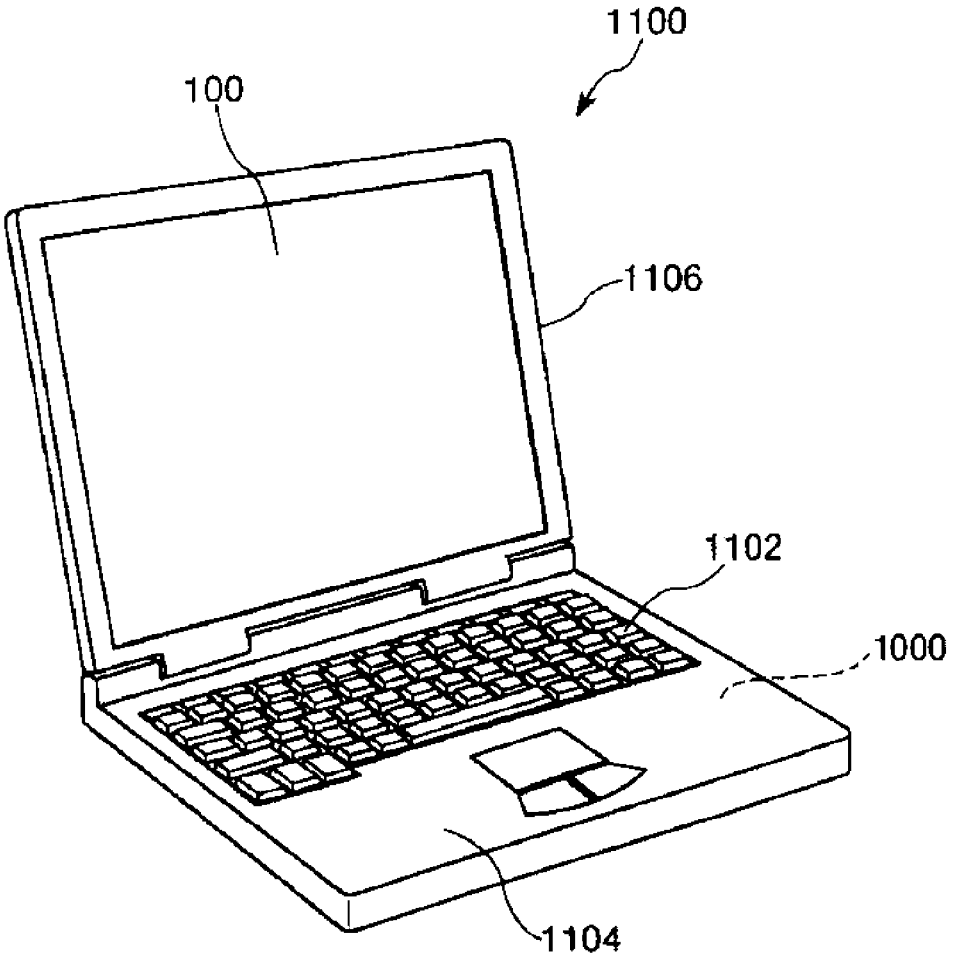
FIG. 3 is a perspective view showing a structure of a mobile (or notebook) personal computer, to which an electronic device including a magnetic element according to an embodiment of the invention is applied.

FIG. 3 is a perspective view showing a structure of a mobile (or notebook) personal computer, to which an electronic device including the magnetic element is applied. In this drawing, a personal computer 1100 includes a main body 1104 provided with a key board 1102, and a display unit 1106 provided with a display section 100. The display unit 1106 is supported rotatably with respect to the main body 1104 via a hinge structure. Such a personal computer 1100 has, for example, a built-in magnetic element 1000 such as a choke coil, an inductor, or a motor for a switching power supply.

Figure 4:
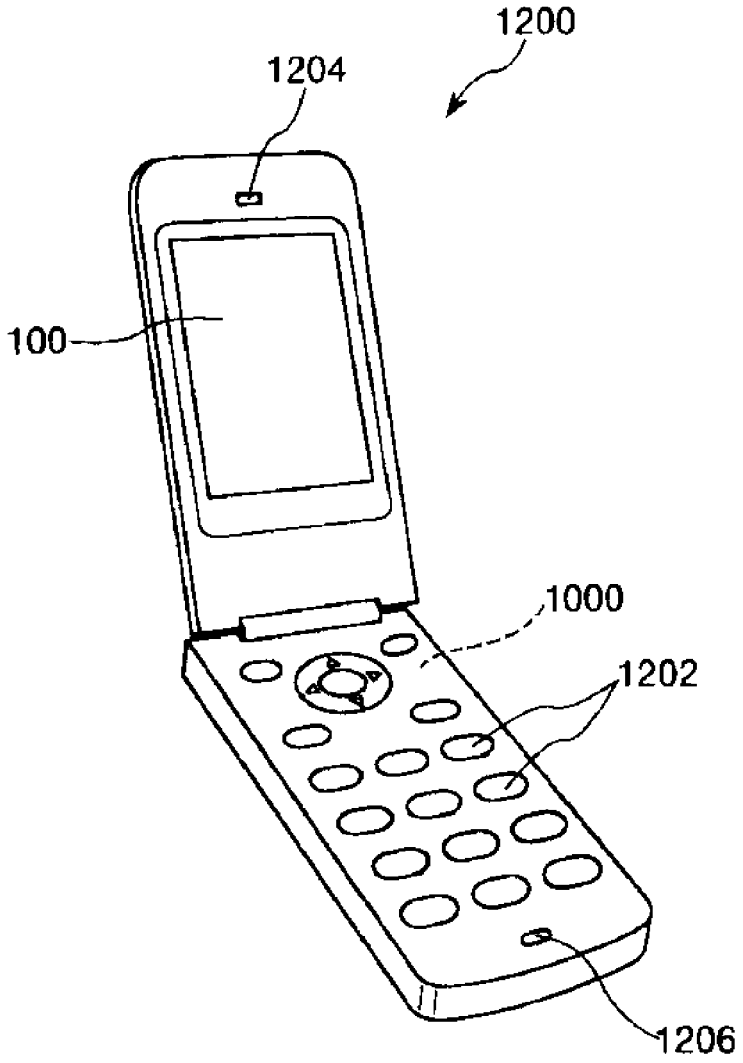
FIG. 4 is a perspective view showing a structure of a cellular phone (also including a PHS), to which an electronic device including a magnetic element according to an embodiment of the invention is applied.

FIG. 4 is a perspective view showing a structure of a cellular phone (also including a PHS), to which an electronic device including the magnetic element is applied. In this drawing, a cellular phone 1200 includes a plurality of operation buttons 1202, an earpiece 1204, and a mouthpiece 1206, and between the operation buttons 1202 and the earpiece 1204, a display section 100 is placed. Such a cellular phone 1200 has, for example, a built-in magnetic element 1000 such as an inductor, a noise filter, or a motor.

Figure 5:
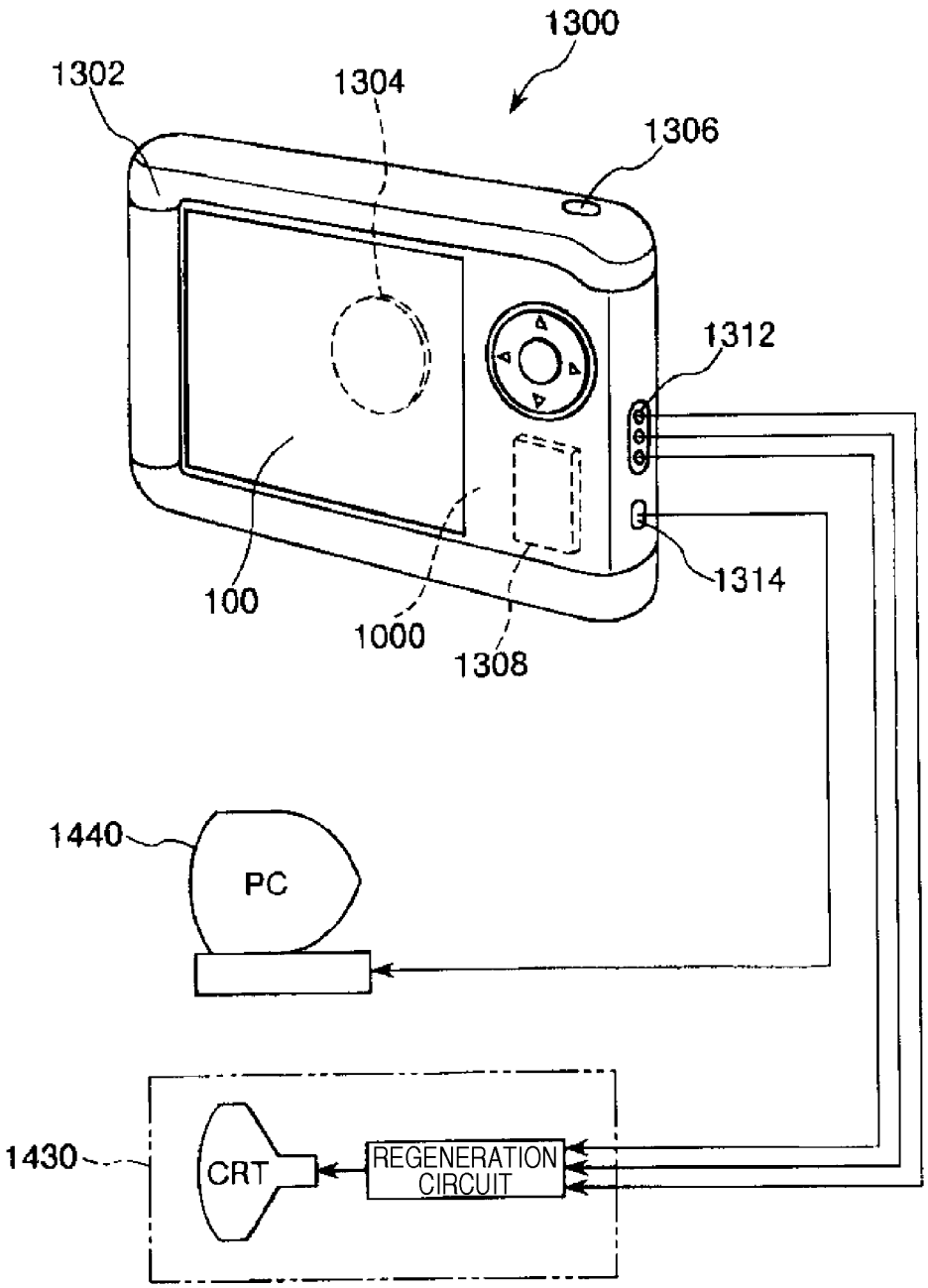
FIG. 5 is a perspective view showing a structure of a digital still camera, to which an electronic device including a magnetic element according to an embodiment of the invention is applied.

FIG. 5 is a perspective view showing a structure of a digital still camera, to which an electronic device including the magnetic element is applied. In this drawing, connection to external apparatuses is also briefly shown. A digital still camera 1300 generates an imaging signal (an image signal) by photoelectrically converting an optical image of a subject into the imaging signal with an imaging device such as a CCD (Charge Coupled Device).

On a back surface of a case (body) 1302 in the digital still camera 1300, a display section is provided, and the display section is configured to display a taken image on the basis of the imaging signal of the CCD. The display section functions as a finder which displays a subject as an electronic image. Further, on a front surface side (on a back surface side in the drawing) of the case 1302, a light receiving unit 1304 including an optical lens (an imaging optical system), a CCD, and the like is provided.

When a person who takes an image confirms the image of a subject displayed on the display section and pushes a shutter button 1306, an imaging signal of the CCD at that time is transferred to a memory 1308 and stored there. Further, a video signal output terminal 1312 and an input/output terminal 1314 for data communication are provided on a side surface of the case 1302 in the digital still camera 1300. As shown in the drawing, a television monitor 1430 and a personal computer 1440 are connected to the video signal output terminal 1312 and the input/output terminal 1314 for data communication, respectively, as desired. Moreover, the digital still camera 1300 is configured such that the imaging signal stored in the memory 1308 is output to the television monitor 1430 or the personal computer 1440 by a predetermined operation. Also such a digital still camera 1300 has, for example, a built-in magnetic element 1000 such as an inductor or a noise filter.

Incidentally, the electronic device including the magnetic element can be applied to, other than the personal computer (mobile personal computer) shown in FIG. 3, the cellular phone shown in FIG. 4, and the digital still camera shown in FIG. 5, for example, inkjet type ejection apparatuses (e.g., inkjet printers), laptop personal computers, televisions, video cameras, videotape recorders, car navigation devices, pagers, electronic notebooks (including those having a communication function), electronic dictionaries, pocket calculators, electronic game devices, word processors, work stations, television telephones, television monitors for crime prevention, electronic binoculars, POS terminals, medical devices (e.g., electronic thermometers, blood pressure meters, blood sugar meters, electrocardiogram monitoring devices, ultrasound diagnostic devices, and electronic endoscopes), fish finders, various measurement devices, gauges (e.g., gauges for vehicles, airplanes, and ships), mobile body controlling apparatuses (e.g., controlling apparatuses for driving vehicles), flight simulators, and the like Hereinabove, the amorphous alloy powder, the dust core, the magnetic element, and the electronic device have been described based on the preferred embodiments, but the invention is not limited thereto.

For example, in the above-described embodiments, as the application example of the amorphous alloy powder, the dust core is described, however, the application example is not limited thereto, and for example, the application example may be a magnetic fluid, a magnetic screening sheet, or a magnetic device such as a magnetic head.

EXAMPLES

Hereinafter, specific examples will be described.

Examples of First Embodiment of Amorphous Alloy Powder

1. Production of Dust Core and Choke Coil

Example 28A (1) First, the starting material was melted in a high-frequency induction furnace, whereby a melt of the starting material was obtained. The obtained melt of the starting material was powdered by a high-speed spinning water atomization method (represented by "spinning water" in each table), whereby amorphous alloy powder particles were obtained. Subsequently, the obtained amorphous alloy powder particles were classified using a standard sieve having a mesh size of 150 μm. The alloy composition of the classified amorphous alloy powder is shown in Table 1. Incidentally, in the determination of the alloy composition, an optical emission spectrometer for solids (a spark emission spectrometer) manufactured by SPECTRO Analytical Instruments GmbH (model: Spectrolab, type: LAVMB08A) was used. Further, in the quantitative analysis of C (carbon) in the amorphous alloy powder particles, a carbon/sulfur analyzer CS-200 manufactured by LECO Corporation was used.

(2) Subsequently, with respect to the obtained amorphous alloy powder, a particle size distribution was measured. This measurement was performed using a laser diffraction particle size distribution analyzer (Microtrack HRA9320-X100, manufactured by Nikkiso Co., Ltd.). Then, based on the particle size distribution, the average particle diameter of the amorphous alloy powder particles was obtained.

(3) Subsequently, the obtained amorphous alloy powder was mixed with an epoxy resin (a binding material) and toluene (an organic solvent), whereby a mixture was obtained. The addition amount of the epoxy resin was set to 2 parts by mass with respect to 100 parts by mass of the amorphous alloy powder.

(4) Subsequently, the obtained mixture was stirred, and then dried by heating at 60° C. for 1 hour, whereby a dry material in the form of lumps was obtained. Then, the thus obtained dry material was classified using a sieve having a mesh size of 500 μm, and the classified dry material was pulverized, whereby a granular powder was obtained.

(5) Subsequently, the obtained granular powder was packed in a mold, and a molded body was prepared under the following molding conditions.

Molding Conditions

Molding method: press-molding

Shape of molded body: ring

Size of molded body: outer diameter: 28 mm, inner diameter: 14 mm, thickness: 10.5 mm Molding pressure: 20 t/cm$^2$ (1.96 GPa)

(6) Subsequently, the molded body was heated in an air atmosphere at 450° C. for 0.5 hours to cure the binding material in the molded body. By doing this, a dust core was obtained.

(7) Subsequently, by using the obtained dust core, a choke coil (a magnetic element) shown in FIG. 1 was produced according to the following production conditions.

Coil Production Conditions

Constituent material of conductive wire: Cu

Conductive wire diameter: 0.5 mm

Winding number (when measuring magnetic permeability): 7 turns

Winding number (when measuring iron loss): 30 turns (primary side), 30 turns (secondary side)

Examples 1A to 10A and Comparative Examples 2A to 6A

Dust cores were obtained in the same manner as in Example 28A except that as the amorphous alloy powder, an amorphous alloy material having an alloy composition shown in Table 1 was used, and by using the obtained dust cores, choke coils were obtained.

TABLE 1

| | | Alloy composition | | | | | | | | | | | | | |
|---|---|---|---|---|---|---|---|---|---|---|---|---|---|---|---|
| | | Cr a | Mn b | Si c | B d | C e | Fe | a + b | b/(a + b) | (a + b)/(c + d + e) | c + d | d/(b + c) | e/(b + c) | b/(c + d) | b/(d + e) |
| | | | | | at % | | | | | | | | | | |
| Sample No. 1 | Example 28A | 0.74 | 1.31 | 12.61 | 10.22 | 1.99 | 73.13 | 2.05 | 0.64 | 0.08 | 22.83 | 0.73 | 0.14 | 0.06 | 0.11 |
| Sample No. 2 | Example 1A | 1.14 | 1.14 | 13.20 | 8.79 | 2.01 | 73.73 | 2.27 | 0.50 | 0.09 | 21.99 | 0.61 | 0.14 | 0.05 | 0.11 |
| Sample No. 3 | Example 2A | 1.14 | 1.14 | 12.11 | 9.89 | 2.00 | 73.72 | 2.28 | 0.50 | 0.10 | 22.00 | 0.75 | 0.15 | 0.05 | 0.10 |
| Sample No. 4 | Example 3A | 1.14 | 1.14 | 11.00 | 11.02 | 1.99 | 73.70 | 2.28 | 0.50 | 0.09 | 22.02 | 0.91 | 0.16 | 0.05 | 0.09 |
| Sample No. 5 | Example 4A | 2.28 | 1.00 | 12.00 | 9.00 | 2.02 | 73.69 | 3.29 | 0.31 | 0.14 | 21.01 | 0.69 | 0.16 | 0.05 | 0.09 |
| Sample No. 6 | Example 5A | 2.28 | 1.14 | 13.21 | 8.78 | 2.01 | 72.58 | 3.42 | 0.33 | 0.14 | 21.99 | 0.61 | 0.14 | 0.05 | 0.11 |
| Sample No. 7 | Example 6A | 2.28 | 1.50 | 11.50 | 8.99 | 1.98 | 73.75 | 3.78 | 0.40 | 0.17 | 20.49 | 0.69 | 0.15 | 0.07 | 0.14 |
| Sample No. 8 | Example 7A | 2.28 | 2.00 | 11.00 | 9.01 | 1.99 | 73.72 | 4.28 | 0.47 | 0.19 | 20.01 | 0.69 | 0.15 | 0.10 | 0.18 |
| Sample No. 9 | Example 8A | 2.28 | 2.28 | 13.20 | 8.78 | 2.01 | 71.45 | 4.56 | 0.50 | 0.19 | 21.99 | 0.57 | 0.13 | 0.10 | 0.21 |
| Sample No. 10 | Example 9A | 2.49 | 2.20 | 11.30 | 8.99 | 2.02 | 72.99 | 4.70 | 0.47 | 0.21 | 20.29 | 0367 | 0.15 | 0.11 | 0.20 |
| Sample No. 11 | Example 10A | 2.83 | 2.40 | 12.19 | 9.22 | 2.16 | 71.19 | 5.23 | 0.46 | 0.22 | 21.41 | 0.63 | 0.15 | 0.11 | 0.21 |
| Sample No. 12 | Comparative Example 2A | 3.13 | 2.59 | 12.68 | 9.28 | 2.00 | 70.31 | 5.72 | 0.45 | 0.24 | 21.97 | 0.61 | 0.13 | 0.12 | 0.23 |
| Sample No. 13 | Comparative Example 3A | 0.00 | 0.76 | 11.09 | 11.18 | 2.03 | 74.95 | 0.76 | 1.00 | 0.03 | 22.27 | 0.94 | 0.17 | 0.03 | 0.06 |
| Sample No. 14 | Comparative Example 4A | 0.00 | 2.27 | 11.32 | 11.03 | 2.18 | 73.20 | 2.27 | 1.00 | 0.09 | 22.35 | 0.81 | 0.16 | 0.10 | 0.17 |
| Sample No. 15 | Comparative Example 5A | 0.00 | 4.57 | 11.25 | 11.14 | 2.22 | 70.82 | 4.57 | 1.00 | 0.19 | 22.40 | 0.70 | 0.14 | 0.20 | 0.34 |
| Sample No. 16 | Comparative Example 6A | 0.00 | 6.83 | 11.33 | 10.96 | 2.03 | 68.86 | 6.83 | 1.00 | 0.28 | 22.29 | 0.60 | 0.11 | 0.31 | 0.53 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 1 | Example 28A | Spinning water | 35.4 | 654 | 1.75 | 1.34 | 52.9 | 50.4 | 299.3 | C |
| Sample No. 2 | Example 1A | Spinning water | 41.3 | 456 | 1.34 | 1.39 | 69.6 | 66.7 | 204.1 | A |
| Sample No. 3 | Example 2A | Spinning water | 36.5 | 497 | 1.33 | 1.38 | 70.2 | 69.7 | 202.2 | A |
| Sample No. 4 | Example 3A | Spinning water | 38.2 | 506 | 1.32 | 1.38 | 70.8 | 70.5 | 200.5 | A |
| Sample No. 5 | Example 4A | Spinning water | 33.2 | 312 | 1.32 | 1.38 | 66.5 | 62.1 | 210.8 | B |
| Sample No. 6 | Example 5A | Spinning water | 47.2 | 311 | 1.30 | 1.30 | 67.2 | 65.1 | 208.2 | A |
| Sample No. 7 | Example 6A | Spinning water | 35.4 | 302 | 1.15 | 1.39 | 81.6 | 79.8 | 174.0 | A |
| Sample No. 8 | Example 7A | Spinning water | 36.4 | 382 | 0.86 | 1.39 | 108.8 | 106.4 | 130.6 | A |
| Sample No. 9 | Example 8A | Spinning water | 40.3 | 331 | 0.75 | 1.22 | 124.0 | 118.2 | 114.6 | A |
| Sample No. 10 | Example 9A | Spinning water | 42.3 | 256 | 0.78 | 1.33 | 119.9 | 116.2 | 118.5 | A |
| Sample No. 11 | Example 10A | Spinning water | 25.4 | 230 | 0.72 | 1.20 | 130.5 | 125.4 | 108.8 | A |
| Sample No. 12 | Comparative Example 2A | Spinning water | 26.3 | 223 | 1.45 | 0.95 | 50.9 | 46.1 | 227.8 | A |

TABLE 1-continued

| | | | | | | | | | | |
|---|---|---|---|---|---|---|---|---|---|---|
| Sample No. 13 | Comparative Example 3A | Spinning water | 27.3 | 614 | 1.87 | 0.88 | 41.3 | 38.8 | 344.0 | E |
| Sample No. 14 | Comparative Example 4A | Spinning water | 21.7 | 674 | 1.76 | 0.85 | 62.1 | 60.5 | 330.3 | E |
| Sample No. 15 | Comparative Example 5A | Spinning water | 33.4 | 563 | 1.58 | 0.68 | 52.7 | 51.4 | 304.5 | E |
| Sample No. 16 | Comparative Example 6A | Spinning water | 32.1 | 584 | 1.68 | 0.55 | 51.2 | 50.6 | 315.6 | E |

Examples 11A to 13A and Comparative Examples 7A to 11A

Dust cores were obtained in the same manner as in Example 28A except that as the amorphous alloy powder, an amorphous alloy material having an alloy composition shown in Table 2 was used, and by using the obtained dust cores, choke coils were obtained.

TABLE 2

| | | Alloy composition | | | | | | | | | | | | | |
|---|---|---|---|---|---|---|---|---|---|---|---|---|---|---|---|
| | | Cr a | Mn b | Si c | B d | C e | Fe | a + b | b/(a + b) | (a + b)/(c + d + e) | c + d | d/(b + c) | e/(b + c) | b/(c + d) | b/(d + e) |
| | | at % | | | | | | | | | | | | | |
| Sample No. 17 | Comparative Example 7A | 2.22 | 0.00 | 10.97 | 10.96 | 2.14 | 73.71 | 2.22 | 0.00 | 0.09 | 21.93 | 1.00 | 0.20 | 0.00 | 0.00 |
| Sample No. 18 | Comparative Example 8A | 2.28 | 0.00 | 13.21 | 8.79 | 2.01 | 73.72 | 2.28 | 0.00 | 0.10 | 21.99 | 0.67 | 0.15 | 0.00 | 0.00 |
| Sample No. 19 | Example 11A | 1.01 | 0.20 | 11.99 | 10.99 | 2.13 | 73.67 | 1.22 | 0.17 | 0.05 | 22.98 | 0.90 | 0.17 | 0.01 | 0.02 |
| Sample No. 20 | Example 12A | 1.39 | 0.72 | 11.87 | 10.61 | 2.03 | 73.39 | 2.10 | 0.34 | 0.09 | 22.48 | 0.84 | 0.16 | 0.03 | 0.06 |
| Sample No. 21 | Example 13A | 2.29 | 3.00 | 12.03 | 10.98 | 2.05 | 69.65 | 5.29 | 0.57 | 0.21 | 23.01 | 0.73 | 0.14 | 0.13 | 0.23 |
| Sample No. 22 | Comparative Example 9A | 2.67 | 5.07 | 11.39 | 11.15 | 2.21 | 67.52 | 7.73 | 0.66 | 0.31 | 22.54 | 0.68 | 0.13 | 0.22 | 0.38 |
| Sample No. 23 | Comparative Example 10A | 2.76 | 7.83 | 9.52 | 10.80 | 2.43 | 66.65 | 10.59 | 0.74 | 0.47 | 20.33 | 0.62 | 0.14 | 0.39 | 0.59 |
| Sample No. 24 | Comparative Example 11A | 3.48 | 11.04 | 10.42 | 8.98 | 1.99 | 64.10 | 14.52 | 0.76 | 0.68 | 19.39 | 0.42 | 0.09 | 0.57 | 1.01 |

| | | | | | | | Magnetic permeability μ' | | Iron loss Bm = 50 mT | |
|---|---|---|---|---|---|---|---|---|---|---|
| | | Powdering method | Average particle diameter μm | Oxygen content ppm | Coercive force Oe | Saturation magnetic flux density T | 100 kHz | 1000 kHz | 100 kHz kW/m³ | Corrosion resistance |
| Sample No. 17 | Comparative Example 7A | Spinning water | 35.0 | 578 | 1.87 | 1.38 | 40.5 | 38.1 | 345.2 | D |
| Sample No. 18 | Comparative Example 8A | Spinning water | 42.3 | 756 | 1.89 | 1.38 | 58.6 | 55.7 | 361.2 | D |
| Sample No. 19 | Example 11A | Spinning water | 25.4 | 330 | 0.84 | 1.38 | 102.6 | 102.1 | 128.2 | C |
| Sample No. 20 | Example 12A | Spinning water | 26.3 | 246 | 0.69 | 1.36 | 112.4 | 112.0 | 104.6 | A |
| Sample No. 21 | Example 13A | Spinning water | 27.3 | 214 | 0.57 | 1.10 | 163.2 | 158.7 | 87.0 | B |
| Sample No. 22 | Comparative Example 9A | Spinning water | 21.7 | 201 | 1.44 | 0.77 | 57.5 | 55.4 | 241.5 | C |
| Sample No. 23 | Comparative Example 10A | Spinning water | 33.4 | 203 | 1.52 | 0.73 | 54.4 | 52.6 | 243.5 | C |
| Sample No. 24 | Comparative Example 11A | Spinning water | 32.1 | 198 | 1.62 | 0.59 | 51.2 | 48.9 | 250.1 | C |

Examples 14A to 16A and Comparative Examples 12A to 16A

Dust cores were obtained in the same manner as in Example 28A except that as the amorphous alloy powder, an amorphous alloy material having an alloy composition shown in Table 3 was used, and by using the obtained dust cores, choke coils were obtained.

TABLE 3

| | | Alloy composition | | | | | | | | | | | | | |
|---|---|---|---|---|---|---|---|---|---|---|---|---|---|---|---|
| | | Cr a | Mn b | Si c | B d | C e | Fe | a + b | b/(a + b) | (a + b)/(c + d + e) | c + d | d/(b + c) | e/(b + c) | b/(c + d) | b/(d + e) |
| | | at % | | | | | | | | | | | | | |
| Sample No. 25 | Comparative Example 12A | 1.37 | 1.20 | 2.72 | 11.44 | 2.24 | 81.03 | 2.57 | 0.47 | 0.16 | 14.16 | 2.92 | 0.57 | 0.08 | 0.09 |
| Sample No. 26 | Comparative Example 13A | 2.98 | 2.82 | 4.97 | 11.38 | 2.13 | 75.72 | 5.80 | 0.49 | 0.31 | 16.35 | 1.46 | 0.27 | 0.17 | 0.21 |
| Sample No. 27 | Comparative Example 14A | 2.74 | 2.60 | 6.03 | 11.47 | 2.27 | 74.88 | 5.34 | 0.49 | 0.27 | 17.51 | 1.33 | 0.26 | 0.15 | 0.19 |
| Sample No. 28 | Example 29A | 2.76 | 2.62 | 9.53 | 10.81 | 2.43 | 71.84 | 5.38 | 0.49 | 0.24 | 20.34 | 0.89 | 0.20 | 0.13 | 0.20 |
| Sample No. 29 | Example 14A | 2.21 | 2.11 | 10.23 | 11.18 | 2.30 | 71.97 | 4.31 | 0.49 | 0.18 | 21.41 | 0.91 | 0.19 | 0.10 | 0.16 |
| Sample No. 30 | Example 15A | 2.30 | 2.30 | 11.42 | 11.00 | 2.21 | 70.76 | 4.60 | 0.50 | 0.19 | 22.43 | 0.80 | 0.16 | 0.10 | 0.17 |
| Sample No. 31 | Example 16A | 2.25 | 2.97 | 13.24 | 11.48 | 2.52 | 67.56 | 5.21 | 0.57 | 0.19 | 24.71 | 0.71 | 0.16 | 0.12 | 0.21 |
| Sample No. 32 | Comparative Example 16A | 2.30 | 3.11 | 16.42 | 11.13 | 2.15 | 64.90 | 5.41 | 0.58 | 0.18 | 27.55 | 0.57 | 0.11 | 0.11 | 0.23 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 25 | Comparative Example 12A | Spinning water | 35.0 | 278 | 2.20 | 2.02 | 55.4 | 53.0 | 334.3 | B |
| Sample No. 26 | Comparative Example 13A | Spinning water | 27.3 | 314 | 2.01 | 1.54 | 61.4 | 58.4 | 299.0 | A |
| Sample No. 27 | Comparative Example 14A | W-atm | 10.5 | 987 | 1.98 | 1.47 | 62.9 | 62.4 | 294.0 | A |
| Sample No. 28 | Example 29A | Spinning water | 33.4 | 263 | 1.77 | 1.25 | 64.2 | 63.9 | 251.6 | A |
| Sample No. 29 | Example 14A | W-atm | 9.8 | 1012 | 0.82 | 1.14 | 114.6 | 110.2 | 123.9 | A |
| Sample No. 30 | Example 15A | Spinning water | 26.4 | 248 | 0.75 | 1.18 | 125.2 | 123.1 | 113.5 | A |
| Sample No. 31 | Example 16A | Spinning water | 33.3 | 269 | 0.58 | 1.12 | 161.4 | 159.6 | 88.0 | A |
| Sample No. 32 | Comparative Example 16A | Spinning water | 32.1 | 284 | 1.55 | 0.83 | 109.3 | 106.9 | 233.9 | B |

Incidentally, in Example 14A and Comparative Example 14A, in place of the high-speed spinning water atomization method, a water atomization method (represented by "W-atm" in the table) was used.

Examples 17A to 21A and Comparative Examples 17A to 21A

Dust cores were obtained in the same manner as in Example 28A except that as the amorphous alloy powder, an amorphous alloy material having an alloy composition shown in Table 4 was used, and by using the obtained dust cores, choke coils were obtained.

Incidentally, in Example 17A and Example 19A, in place of the high-speed spinning water atomization method, a water atomization method (represented by "W-atm" in the table) was used.

Examples 22A to 27A and Comparative Examples 22A to 24A

Dust cores were obtained in the same manner as in Example 28A except that as the amorphous alloy powder, an amorphous alloy material having an alloy composition shown in Table 5 was used, and by using the obtained dust cores, choke coils were obtained.

TABLE 4

| | | Alloy composition | | | | | | | | | | | | | |
|---|---|---|---|---|---|---|---|---|---|---|---|---|---|---|---|
| | | Cr a | Mn b | Si c at % | B d | C e | Fe | a + b | b/ (a + b) | (a + b)/ (c + d + e) | c + d | d/ (b + c) | e/ (b + c) | b/ (c + d) | b/ (d + e) |
| Sample No. 33 | Comparative Example 17A | 1.21 | 1.21 | 11.74 | 2.60 | 2.67 | 80.57 | 2.41 | 0.50 | 0.14 | 14.34 | 0.20 | 0.21 | 0.08 | 0.23 |
| Sample No. 34 | Comparative Example 18A | 1.19 | 1.19 | 11.82 | 5.14 | 2.25 | 78.40 | 2.38 | 0.50 | 0.12 | 16.97 | 0.40 | 0.17 | 0.07 | 0.16 |
| Sample No. 35 | Comparative Example 19A | 1.17 | 1.17 | 11.44 | 7.74 | 2.36 | 76.12 | 2.34 | 0.50 | 0.11 | 19.18 | 0.61 | 0.19 | 0.06 | 0.12 |
| Sample No. 36 | Example 17A | 2.29 | 1.00 | 11.79 | 8.50 | 2.42 | 74.00 | 3.29 | 0.31 | 0.15 | 20.29 | 0.66 | 0.19 | 0.05 | 0.09 |
| Sample No. 37 | Example 18A | 2.29 | 1.15 | 11.61 | 8.83 | 2.45 | 73.67 | 3.44 | 0.33 | 0.15 | 20.44 | 0.69 | 0.19 | 0.06 | 0.10 |
| Sample No. 38 | Example 19A | 2.25 | 1.48 | 11.68 | 9.71 | 2.47 | 72.42 | 3.73 | 0.40 | 0.16 | 21.38 | 0.74 | 0.19 | 0.07 | 0.12 |
| Sample No. 39 | Example 20A | 2.24 | 1.96 | 10.65 | 10.67 | 2.50 | 71.98 | 4.20 | 0.47 | 0.18 | 21.32 | 0.85 | 0.20 | 0.09 | 0.15 |
| Sample No. 40 | Example 21A | 2.20 | 1.93 | 10.29 | 12.70 | 2.46 | 70.42 | 4.13 | 0.47 | 0.16 | 22.99 | 1.04 | 0.20 | 0.08 | 0.13 |
| Sample No. 41 | Comparative Example 20A | 2.21 | 2.20 | 10.07 | 13.73 | 2.47 | 69.32 | 4.41 | 0.50 | 0.17 | 23.80 | 1.12 | 0.20 | 0.09 | 0.14 |
| Sample No. 42 | Comparative Example 21A | 2.32 | 2.05 | 10.66 | 16.45 | 2.36 | 66.17 | 4.37 | 0.47 | 0.15 | 27.10 | 1.29 | 0.19 | 0.08 | 0.11 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 33 | Comparative Example 17A | Spinning water | 33.0 | 354 | 2.84 | 1.37 | 65.6 | 63.2 | 431.1 | B |
| Sample No. 34 | Comparative Example 18A | Spinning water | 31.6 | 264 | 2.11 | 1.38 | 64.8 | 61.9 | 319.4 | A |
| Sample No. 35 | Comparative Example 19A | Spinning water | 35.0 | 278 | 2.13 | 1.39 | 63.8 | 63.3 | 322.5 | A |
| Sample No. 36 | Example 17A | W-atm | 8.5 | 1123 | 1.41 | 1.41 | 81.2 | 80.9 | 219.8 | B |
| Sample No. 37 | Example 18A | Spinning water | 35.2 | 264 | 1.40 | 1.38 | 85.5 | 81.0 | 207.1 | A |
| Sample No. 38 | Example 19A | W-atm | 10.6 | 945 | 1.16 | 1.29 | 90.6 | 88.5 | 176.2 | A |
| Sample No. 39 | Example 20A | Spinning water | 29.0 | 248 | 0.88 | 1.26 | 106.8 | 105.0 | 133.0 | A |
| Sample No. 40 | Example 21A | Spinning water | 26.4 | 284 | 0.82 | 1.24 | 105.0 | 102.6 | 129.6 | A |
| Sample No. 41 | Comparative Example 20A | Spinning water | 24.6 | 331 | 1.88 | 1.08 | 59.9 | 57.5 | 288.5 | A |
| Sample No. 42 | Comparative Example 21A | Spinning water | 26.6 | 354 | 2.04 | 0.90 | 51.5 | 45.8 | 327.0 | B |

TABLE 5

| | | Alloy composition | | | | | | | | |
|---|---|---|---|---|---|---|---|---|---|---|
| | | Cr a | Mn b | Si c | B d | C e | Fe | a + b | b/ (a + b) | (a + b)/ (c + d + e) |
| | | | | | at % | | | | | |
| Sample No. 43 | Comparative Example 22A | 1.15 | 1.14 | 11.84 | 10.75 | 0.08 | 75.04 | 2.29 | 0.50 | 0.10 |
| Sample No. 44 | Comparative Example 23A | 1.17 | 1.16 | 11.22 | 9.92 | 0.24 | 76.29 | 2.33 | 0.50 | 0.11 |
| Sample No. 45 | Example 22A | 1.15 | 1.16 | 11.56 | 10.36 | 1.07 | 74.71 | 2.31 | 0.50 | 0.10 |
| Sample No. 46 | Example 23A | 2.27 | 1.00 | 11.03 | 10.79 | 1.34 | 73.57 | 3.27 | 0.31 | 0.14 |
| Sample No. 47 | Example 24A | 2.25 | 1.13 | 11.25 | 11.33 | 2.13 | 71.91 | 3.38 | 0.33 | 0.14 |
| Sample No. 48 | Example 25A | 2.22 | 1.46 | 11.28 | 11.63 | 2.24 | 71.16 | 3.68 | 0.40 | 0.15 |
| Sample No. 49 | Example 26A | 2.21 | 1.94 | 11.07 | 11.36 | 2.74 | 70.67 | 4.15 | 0.47 | 0.16 |
| Sample No. 50 | Example 27A | 2.23 | 2.23 | 10.82 | 11.71 | 2.88 | 70.13 | 4.46 | 0.50 | 0.18 |
| Sample No. 51 | Comparative Example 24A | 2.39 | 2.11 | 11.19 | 11.73 | 3.91 | 68.66 | 4.50 | 0.47 | 0.17 |

| | | Alloy Composition | | | | | | Average particle | Oxygen |
|---|---|---|---|---|---|---|---|---|---|
| | | c + d | d/ (b + c) | e/ (b + c) | b/ (c + d) | b/ (d + e) | Powdering method | diameter μm | content ppm |
| Sample No. 43 | Comparative Example 22A | 22.59 | 0.83 | 0.01 | 0.05 | 0.11 | Spinning water | 28.7 | 341 |
| Sample No. 44 | Comparative Example 23A | 21.14 | 0.80 | 0.02 | 0.06 | 0.11 | Spinning water | 20.8 | 264 |
| Sample No. 45 | Example 22A | 21.91 | 0.81 | 0.08 | 0.05 | 0.10 | Spinning water | 34.4 | 312 |
| Sample No. 46 | Example 23A | 21.83 | 0.90 | 0.11 | 0.05 | 0.08 | W-atm | 11.2 | 879 |
| Sample No. 47 | Example 24A water | 22.58 | 0.92 | 0.17 | 0.05 | 0.08 | Spinning water | 25.9 | 294 |
| Sample No. 48 | Example 25A | 22.91 | 0.91 | 0.18 | 0.06 | 0.11 | W-atm | 8.9 | 1254 |
| Sample No. 49 | Example 26A water | 22.44 | 0.87 | 0.21 | 0.09 | 0.14 | Spinning water | 27.6 | 301 |
| Sample No. 50 | Example 27A water | 22.53 | 0.90 | 0.22 | 0.10 | 0.15 | Spinning water | 22.8 | 323 |
| Sample No. 51 | Comparative Example 24A | 22.93 | 0.88 | 0.29 | 0.09 | 0.13 | Spinning water | 32.1 | 314 |

| | | Coercive force | Saturation magnetic flux density | Magnetic permeability μ' | | Iron loss Bm = 50 mT 100 kHz | Corrosion |
|---|---|---|---|---|---|---|---|
| | | Oe | T | 100 kHz | 1000 kHz | kW/m³ | resistance |
| Sample No. 43 | Comparative Example 22A | 2.65 | 1.39 | 62.3 | 59.8 | 402.0 | C |
| Sample No. 44 | Comparative Example 23A | 2.26 | 1.44 | 63.3 | 60.4 | 342.3 | B |
| Sample No. 45 | Example 22A | 1.16 | 1.46 | 80.6 | 80.1 | 176.3 | A |
| Sample No. 46 | Example 23A | 1.09 | 1.37 | 85.6 | 85.3 | 165.8 | B |
| Sample No. 47 | Example 24A water | 1.03 | 1.25 | 91.2 | 86.8 | 155.7 | A |
| Sample No. 48 | Example 25A | 1.01 | 1.20 | 92.6 | 90.6 | 153.3 | A |
| Sample No. 49 | Example 26A water | 0.89 | 1.17 | 105.6 | 103.8 | 134.5 | A |
| Sample No. 50 | Example 27A water | 0.77 | 1.13 | 121.2 | 118.9 | 117.1 | A |
| Sample No. 51 | Comparative Example 24A | 1.52 | 1.04 | 64.8 | 59.0 | 233.7 | B |

Incidentally, in Example 23A and Example 25A, in place of the high-speed spinning water atomization method, a water atomization method (represented by "W-atm" in the table) was used.

2. Evaluation of Amorphous Alloy Powder, Dust Core, and Choke Coil 2.1 Measurement of Oxygen Content in Amorphous Alloy Powder With respect to the amorphous alloy powders obtained in the respective Examples and Comparative Examples, the oxygen content in the particles thereof was measured using a simultaneous oxygen/nitrogen analyzer (TC-300/EF-300, manufactured by LECO Corporation).

2.2 Measurement of Magnetic Properties of Amorphous Alloy Powder

With respect to the amorphous alloy powders obtained in the respective Examples and Comparative Examples, the coercive force and the saturation magnetic flux density were measured according to the following measurement conditions.

Measurement Conditions

Maximum Magnetic Field in Measurement: 10 kOe

Measurement device: vibrating sample magnetometer (VSM 1230-MHHL, manufactured by Tamakawa Co., Ltd.)

2.3 Measurement of Magnetic Properties of Choke Coil

With respect to the choke coils obtained in the respective Examples and Comparative Examples, the magnetic permeability μ' and the iron loss (core loss Pcv) were measured according to the following measurement conditions.

Measurement Conditions for Magnetic Permeability μ'

Measurement frequency: 100 kHz, 1000 kHz

Measurement device: impedance analyzer (HP 4194A, manufactured by Hewlett-Packard Development Company, L.P.)

Measurement Conditions for Iron Loss (Core Loss Pcv)

Measurement frequency: 100 kHz

Maximum magnetic flux density: 50 mT

Measurement device: AC Magnetic Property Measurement System (B-H analyzer SY8258, manufactured by Iwatsu Test Instruments Corporation)

2.4 Evaluation of Corrosion Resistance

The corrosion resistance of each dust core was evaluated by observing and comparing the appearance of each of the choke coils obtained in the respective Examples and Comparative Examples under a high-temperature and high-humidity environment.

The high-temperature and high-humidity environment was created in a thermo-humidistat unit (manufactured by Daikenrikagaku Corporation), and the temperature was set to 85° C. and the relative humidity was set to 90%. Each of the choke coils was placed under the high-temperature and high-humidity environment, and the appearance thereof after 5 days was compared with that before it was placed under the high-temperature and high-humidity environment, and the choke coil was evaluated according to the following evaluation criteria.

Evaluation Criteria for Corrosion Resistance

A: The ratio of the area in which rust was caused to the surface area of the choke coil was less than 1%.

B: The ratio of the area in which rust was caused to the surface area of the choke coil was 1% or more and less than 10%.

C: The ratio of the area in which rust was caused to the surface area of the choke coil was 10% or more and less than 25%.

D: The ratio of the area in which rust was caused to the surface area of the choke coil was 25% or more and less than 50%.

E: The ratio of the area in which rust was caused to the surface area of the choke coil was 50% or more.

The evaluation results are shown in Tables 1 to 5.

As apparent from Tables 1 to 5, it was confirmed that in the amorphous alloy powders and the choke coils obtained in the respective Examples, both of the saturation magnetic flux density and the magnetic permeability are relatively high and the coercive force is relatively low. Based on these evaluation results, it was confirmed that the amorphous alloy powders obtained in the respective Examples have a smaller magnetostriction than the amorphous alloy powders obtained in the respective Comparative Examples. Accordingly, it was confirmed that the amorphous alloy powders and the choke coils obtained in the respective Examples can highly achieve both low iron loss and excellent magnetic properties. Further, it was also confirmed that the amorphous alloy powders and the choke coils obtained in the respective Examples have excellent corrosion resistance.

On the other hand, it was confirmed that in the amorphous alloy powders and the choke coils obtained in the respective Comparative Examples, either of the saturation magnetic flux density and the magnetic permeability is relatively low or the coercive force is relatively high. That is, it was confirmed that these amorphous alloy powders and choke coils hardly achieve a low iron loss and high magnetic properties to a high level. It was also confirmed that the amorphous alloy powders and the choke coils obtained in the respective Comparative Examples have poor corrosion resistance.

Examples of Second Embodiment of Amorphous Alloy Powder

1. Production of Dust Core and Choke Coil

Examples 1B to 9B and Comparative Examples 1B to 6B

Dust cores were obtained in the same manner as in the above-described Example 28A of the first embodiment of the amorphous alloy powder except that as the amorphous alloy powder, an amorphous alloy material having an alloy composition shown in Table 6 was used, and by using the obtained dust cores, choke coils were obtained.

TABLE 6

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a + b) | b/ (c + d) | (a + b)/ (c + d + e) | a + e |
| | | at % | | | | | | | | | | | |
| Sample No. 1 | Example 25B | 0.74 | 1.31 | 12.61 | 10.22 | 1.99 | 73.13 | 1.78 | 2.05 | 0.97 | 0.06 | 0.08 | 2.73 |
| Sample No. 2 | Example 1B | 1.14 | 1.14 | 13.20 | 8.79 | 2.01 | 73.73 | 1.00 | 2.27 | 0.88 | 0.05 | 0.09 | 3.14 |
| Sample No. 3 | Example 2B | 1.14 | 1.14 | 12.11 | 9.89 | 2.00 | 73.72 | 1.00 | 2.28 | 0.88 | 0.05 | 0.10 | 3.14 |
| Sample No. 4 | Example 3B | 1.14 | 1.14 | 11.00 | 11.02 | 1.99 | 73.70 | 1.01 | 2.28 | 0.87 | 0.05 | 0.09 | 3.13 |
| Sample No. 5 | Example 4B | 2.28 | 1.00 | 12.00 | 9.00 | 2.02 | 73.69 | 0.44 | 3.29 | 0.61 | 0.05 | 0.14 | 4.30 |
| Sample No. 6 | Example 5B | 2.28 | 1.14 | 13.21 | 8.78 | 2.01 | 72.58 | 0.50 | 3.42 | 0.59 | 0.05 | 0.14 | 4.29 |
| Sample No. 7 | Example 6B | 2.28 | 1.50 | 11.50 | 8.99 | 1.98 | 73.75 | 0.66 | 3.78 | 0.52 | 0.07 | 0.17 | 4.26 |
| Sample No. 8 | Example 7B | 2.28 | 2.00 | 11.00 | 9.01 | 1.99 | 73.72 | 0.88 | 4.28 | 0.46 | 0.10 | 0.19 | 4.27 |
| Sample No. 9 | Example 8B | 2.28 | 2.28 | 13.20 | 8.78 | 2.01 | 71.45 | 1.00 | 4.56 | 0.44 | 0.10 | 0.19 | 4.29 |
| Sample No. 10 | Example 9B | 2.49 | 2.20 | 11.30 | 8.99 | 2.02 | 72.99 | 0.88 | 4.70 | 0.43 | 0.11 | 0.21 | 4.52 |
| Sample No. 11 | Comparative Example 2B | 3.13 | 2.59 | 12.68 | 9.28 | 2.00 | 70.31 | 0.83 | 5.72 | 0.35 | 0.12 | 0.24 | 5.13 |
| Sample No. 12 | Comparative Example 3B | 0.00 | 0.76 | 11.09 | 11.18 | 2.03 | 74.95 | — | 0.76 | 2.67 | 0.03 | 0.03 | 2.03 |
| Sample No. 13 | Comparative Example 4B | 0.00 | 2.27 | 11.32 | 11.03 | 2.18 | 73.20 | — | 2.27 | 0.96 | 0.10 | 0.09 | 2.18 |

TABLE 6-continued

| | | | | | | | | | | | | | |
|---|---|---|---|---|---|---|---|---|---|---|---|---|---|
| Sample No. 14 | Comparative Example 5B | 0.00 | 4.57 | 11.25 | 11.14 | 2.22 | 70.82 | — | 4.57 | 0.48 | 0.20 | 0.19 | 2.22 |
| Sample No. 15 | Comparative Example 6B | 0.00 | 6.83 | 11.33 | 10.96 | 2.03 | 68.86 | — | 6.83 | 0.30 | 0.31 | 0.28 | 2.03 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m$^3$ | Corrosion resistance |
|---|---|---|---|---|---|---|---|---|---|---|
| Sample No. 1 | Example 25B | Spinning water | 35.4 | 654 | 1.75 | 1.34 | 52.9 | 50.4 | 299.3 | C |
| Sample No. 2 | Example 1B | Spinning water | 41.3 | 456 | 1.34 | 1.39 | 69.6 | 66.7 | 204.1 | A |
| Sample No. 3 | Example 2B | Spinning water | 36.5 | 497 | 1.33 | 1.38 | 70.2 | 69.7 | 202.2 | A |
| Sample No. 4 | Example 3B | Spinning water | 38.2 | 506 | 1.32 | 1.38 | 70.8 | 70.5 | 200.5 | A |
| Sample No. 5 | Example 4B | Spinning water | 33.2 | 312 | 1.32 | 1.38 | 66.5 | 62.1 | 210.8 | B |
| Sample No. 6 | Example 5B | Spinning water | 47.2 | 311 | 1.30 | 1.30 | 67.2 | 65.1 | 208.2 | A |
| Sample No. 7 | Example 6B | Spinning water | 35.4 | 302 | 1.15 | 1.39 | 81.6 | 79.8 | 174.0 | A |
| Sample No. 8 | Example 7B | Spinning water | 36.4 | 382 | 0.86 | 1.39 | 108.8 | 106.4 | 130.6 | A |
| Sample No. 9 | Example 8B | Spinning water | 40.3 | 331 | 0.75 | 1.22 | 124.0 | 118.2 | 114.6 | A |
| Sample No. 10 | Example 9B | Spinning water | 42.3 | 256 | 0.78 | 1.33 | 119.9 | 116.2 | 118.5 | A |
| Sample No. 11 | Comparative Example 2B | Spinning water | 26.3 | 223 | 1.45 | 0.95 | 50.9 | 46.1 | 227.8 | A |
| Sample No. 12 | Comparative Example 3B | Spinning water | 27.3 | 614 | 1.87 | 0.88 | 41.3 | 38.8 | 344.0 | E |
| Sample No. 13 | Comparative Example 4B | Spinning water | 21.7 | 674 | 1.76 | 0.85 | 62.1 | 60.5 | 330.3 | E |
| Sample No. 14 | Comparative Example 5B | Spinning water | 33.4 | 563 | 1.58 | 0.68 | 52.7 | 51.4 | 304.5 | E |
| Sample No. 15 | Comparative Example 6B | Spinning water | 32.1 | 584 | 1.68 | 0.55 | 51.2 | 50.6 | 315.6 | E |

Example 10B and Comparative Examples 7B to 10B

Dust cores were obtained in the same manner as in the above-described Example 28A of the first embodiment of the amorphous alloy powder except that as the amorphous alloy powder, an amorphous alloy material having an alloy composition shown in Table 7 was used, and by using the obtained dust cores, choke coils were obtained.

TABLE 7

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/(a + b) | b/(c + d) | (a + b)/(c + d + e) | a + e |
| | | at % | | | | | | | | | | | |
| Sample No. 16 | Comparative Example 7B | 2.22 | 0.00 | 10.97 | 10.96 | 2.14 | 73.71 | 0.00 | 2.22 | 0.97 | 0.00 | 0.09 | 4.36 |
| Sample No. 17 | Comparative Example 8B | 2.28 | 0.00 | 13.21 | 8.79 | 2.01 | 73.72 | 0.00 | 2.28 | 0.88 | 0.00 | 0.10 | 4.29 |
| Sample No. 18 | Example 10B | 2.29 | 3.00 | 12.03 | 10.98 | 2.05 | 69.65 | 1.31 | 5.29 | 0.39 | 0.03 | 0.21 | 4.35 |
| Sample No. 19 | Comparative Example 9B | 2.76 | 7.83 | 9.52 | 10.80 | 2.43 | 66.65 | 2.83 | 10.59 | 0.23 | 0.39 | 0.47 | 5.19 |
| Sample No. 20 | Comparative Example 10B | 3.48 | 11.04 | 10.42 | 8.98 | 1.99 | 64.10 | 3.18 | 14.52 | 0.14 | 0.57 | 0.68 | 5.47 |

TABLE 7-continued

| | | Powder-ing method | Average particle diameter μm | Oxygen content ppm | Coer-cive force Oe | Saturation magnetic flux density T | Magnetic permeability μ' 100 kHz | Magnetic permeability μ' 1000 kHz | Iron loss Bm = 50 mT 100 kHz kW/m3 | Corr-osion resis-tance |
|---|---|---|---|---|---|---|---|---|---|---|
| Sample No. 16 | Comparative Example 7B | Spinning water | 35.0 | 578 | 1.87 | 1.38 | 40.5 | 38.1 | 345.2 | D |
| Sample No. 17 | Comparative Example 8B | Spinning water | 42.3 | 756 | 1.89 | 1.38 | 58.6 | 55.7 | 361.2 | D |
| Sample No. 18 | Example 10B | Spinning water | 27.3 | 214 | 0.57 | 1.10 | 163.2 | 158.7 | 87.0 | B |
| Sample No. 19 | Comparative Example 9B | Spinning water | 33.4 | 203 | 1.52 | 0.73 | 54.4 | 52.6 | 243.5 | C |
| Sample No. 20 | Comparative Example 10B | Spinning water | 32.1 | 198 | 1.62 | 0.59 | 51.2 | 48.9 | 250.1 | C |

Examples 11B to 13B

Dust cores were obtained in the same manner as in the above-described Example 28A of the first embodiment of the amorphous alloy powder except that as the amorphous alloy powder, an amorphous alloy material having an alloy composition shown in Table 8 was used, and by using the obtained dust cores, choke coils were obtained.

Table 8

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a + b) | b/ (c + d) | (a + b)/ (c + d + e) | a + e |
| | | at % | | | | | | | | | | | |
| Sample No. 21 | Example 11B | 2.21 | 2.11 | 10.23 | 11.18 | 2.30 | 71.97 | 0.95 | 4.31 | 0.53 | 0.10 | 0.18 | 4.51 |
| Sample No. 22 | Example 12B | 2.30 | 2.30 | 11.42 | 11.00 | 2.21 | 70.76 | 1.00 | 4.60 | 0.48 | 0.10 | 0.19 | 4.51 |
| Sample No. 23 | Example 13B | 2.25 | 2.97 | 13.24 | 11.48 | 2.52 | 67.56 | 1.32 | 5.21 | 0.48 | 0.12 | 0.19 | 4.76 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m$^3$ | Corrosion resistance |
|---|---|---|---|---|---|---|---|---|---|---|
| Sample No. 21 | Example 11B | W-atm | 9.8 | 1012 | 0.82 | 1.14 | 114.6 | 110.2 | 123.9 | A |
| Sample No. 22 | Example 12B | Spinning water | 26.4 | 248 | 0.75 | 1.18 | 125.2 | 123.1 | 113.5 | A |
| Sample No. 23 | Example 13B | Spinning water | 33.3 | 269 | 0.58 | 1.12 | 161.4 | 159.6 | 88.0 | A |

Incidentally, in Example 11B, in place of the high-speed spinning water atomization method, a water atomization method (represented by "W-atm" in the table) was used.

Examples 14B to 18B and Comparative Examples 11B and 12B

Dust cores were obtained in the same manner as in the above-described Example 28A of the first embodiment of the amorphous alloy powder except that as the amorphous alloy powder, an amorphous alloy material having an alloy composition shown in Table 9 was used, and by using the obtained dust cores, choke coils were obtained.

TABLE 9

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a+ b) | b/ (c + d) | (a + b)/ (c + d + e) | a + e |
| | | at % | | | | | | | | | | | |
| Sample No. 24 | Comparative Example 11B | 1.17 | 1.17 | 11.44 | 7.74 | 2.36 | 76.12 | 1.01 | 2.34 | 1.01 | 0.06 | 0.11 | 3.53 |
| Sample No. 25 | Example 14B | 2.29 | 1.00 | 11.79 | 8.50 | 2.42 | 74.00 | 0.44 | 3.29 | 0.73 | 0.05 | 0.15 | 4.70 |

TABLE 9-continued

| | | | | | | | | | | | | | |
|---|---|---|---|---|---|---|---|---|---|---|---|---|---|
| Sample No. 26 | Example 15B | 2.29 | 1.15 | 11.61 | 8.83 | 2.45 | 73.67 | 0.50 | 3.44 | 0.71 | 0.06 | 0.15 | 4.74 |
| Sample No. 27 | Example 16B | 2.25 | 1.48 | 11.68 | 9.71 | 2.47 | 72.42 | 0.66 | 3.73 | 0.66 | 0.07 | 0.16 | 4.72 |
| Sample No. 28 | Example 17B | 2.24 | 1.96 | 10.65 | 10.67 | 2.50 | 71.98 | 0.88 | 4.20 | 0.59 | 0.09 | 0.18 | 4.73 |
| Sample No. 29 | Example 18B | 2.20 | 1.93 | 10.29 | 12.70 | 2.46 | 70.42 | 0.88 | 4.13 | 0.59 | 0.08 | 0.16 | 4.65 |
| Sample No. 30 | Comparative Example 12B | 2.21 | 2.20 | 10.07 | 13.73 | 2.47 | 69.32 | 1.00 | 4.41 | 0.56 | 0.09 | 0.17 | 4.68 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 24 | Comparative Example 11B | Spinning water | 35.0 | 278 | 2.13 | 1.39 | 63.8 | 63.3 | 322.5 | A |
| Sample No. 25 | Example 14B | W-atm | 8.5 | 1123 | 1.41 | 1.41 | 81.2 | 80.9 | 219.8 | B |
| Sample No. 26 | Example 15B | Spinning water | 35.2 | 264 | 1.40 | 1.38 | 85.5 | 81.0 | 207.1 | A |
| Sample No. 27 | Example 16B | W-atm | 10.6 | 945 | 1.16 | 1.29 | 90.6 | 88.5 | 176.2 | A |
| Sample No. 28 | Example 17B | Spinning water | 29.0 | 248 | 0.88 | 1.26 | 106.8 | 105.0 | 133.0 | A |
| Sample No. 29 | Example 18B | Spinning water | 26.4 | 284 | 0.82 | 1.24 | 105.0 | 102.6 | 129.6 | A |
| Sample No. 30 | Comparative Example 12B | Spinning water | 24.6 | 331 | 1.88 | 1.08 | 59.9 | 57.5 | 288.5 | A |

Incidentally, in Examples 14B and 16B, in place of the high-speed spinning water atomization method, a water atomization method (represented by "W-atm" in the table) was used.

Examples 19B to 24B and Comparative Examples 13B and 14B

Dust cores were obtained in the same manner as in the above-described Example 28A of the first embodiment of the amorphous alloy powder except that as the amorphous alloy powder, an amorphous alloy material having an alloy composition shown in Table 10 was used, and by using the obtained dust cores, choke coils were obtained.

TABLE 10

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/(a + b) | b/(c + d) | (a + b)/(c + d + e) | a + e |
| | | at % | | | | | | | | | | | |
| Sample No. 31 | Comparative Example 13B | 1.17 | 1.16 | 11.22 | 9.92 | 0.24 | 76.29 | 1.00 | 2.33 | 0.10 | 0.06 | 0.11 | 1.41 |
| Sample No. 32 | Example 19B | 1.15 | 1.16 | 11.56 | 10.36 | 1.07 | 74.71 | 1.01 | 2.31 | 0.46 | 0.05 | 0.10 | 2.22 |
| Sample No. 33 | Example 20B | 2.27 | 1.00 | 11.03 | 10.79 | 1.34 | 73.57 | 0.44 | 3.27 | 0.41 | 0.05 | 0.14 | 3.61 |
| Sample No. 34 | Example 21B | 2.25 | 1.13 | 11.25 | 11.33 | 2.13 | 71.91 | 0.50 | 3.38 | 0.63 | 0.05 | 0.14 | 4.38 |
| Sample No. 35 | Example 22B | 2.22 | 1.46 | 11.28 | 11.63 | 2.24 | 71.16 | 0.66 | 3.68 | 0.61 | 0.06 | 0.15 | 4.46 |
| Sample No. 36 | Example 23B | 2.21 | 1.94 | 11.07 | 11.36 | 2.74 | 70.67 | 0.88 | 4.15 | 0.66 | 0.09 | 0.16 | 4.95 |
| Sample No. 37 | Example 24B | 2.23 | 2.23 | 10.82 | 11.71 | 2.88 | 70.13 | 1.00 | 4.46 | 0.65 | 0.10 | 0.18 | 5.11 |
| Sample No. 38 | Comparative Example 14B | 2.39 | 2.11 | 11.19 | 11.73 | 3.91 | 68.66 | 0.88 | 4.50 | 0.87 | 0.09 | 0.17 | 6.30 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 31 | Comparative Example 13B | Spinning water | 20.8 | 264 | 2.26 | 1.44 | 63.3 | 60.4 | 342.3 | B |

TABLE 10-continued

| | | | | | | | | | | |
|---|---|---|---|---|---|---|---|---|---|---|
| Sample No. 32 | Example 19B | Spinning water | 34.4 | 312 | 1.16 | 1.46 | 80.6 | 80.1 | 176.3 | A |
| Sample No. 33 | Example 20B | W-atm | 11.2 | 879 | 1.09 | 1.37 | 85.6 | 85.3 | 165.8 | B |
| Sample No. 34 | Example 21B | Spinning water | 25.9 | 294 | 1.03 | 1.25 | 91.2 | 86.8 | 155.7 | A |
| Sample No. 35 | Example 22B | W-atm | 8.9 | 1254 | 1.01 | 1.20 | 92.6 | 90.6 | 153.3 | A |
| Sample No. 36 | Example 23B | Spinning water | 27.6 | 301 | 0.89 | 1.17 | 105.6 | 103.8 | 134.5 | A |
| Sample No. 37 | Example 24B | Spinning water | 22.8 | 323 | 0.77 | 1.13 | 121.2 | 118.9 | 117.1 | A |
| Sample No. 38 | Comparative Example 14B | Spinning water | 32.1 | 314 | 1.52 | 1.04 | 64.8 | 59.0 | 233.7 | B |

Incidentally, in Examples 20B and 22B, in place of the high-speed spinning water atomization method, a water atomization method (represented by "W-atm" in the table) was used.

2. Evaluation of Amorphous Alloy Powder, Dust Core, and Choke Coil

The amorphous alloy powders and the choke coils obtained in the respective Examples and Comparative Examples were evaluated using the same evaluation methods as those used in "Examples of First Embodiment of Amorphous Alloy Powder" described above. The evaluation results are shown in each table.

As apparent from each table, it was confirmed that the amorphous alloy powders and the choke coils obtained in the respective Examples have a low coercive force and a high magnetic permeability μ'. Accordingly, it was confirmed that the amorphous alloy powders used for producing the choke coils have a smaller magnetostriction than the amorphous alloy powders obtained in the respective Comparative Examples. Further, it was confirmed that the amorphous alloy powders and the choke coils obtained in the respective Examples have excellent corrosion resistance.

Examples of Third Embodiment of Amorphous Alloy Powder

1. Production of Dust Core and Choke Coil

Example 1C and Comparative Examples 1C and 2C

Dust cores were obtained in the same manner as in the above-described Example 28A of the first embodiment of the amorphous alloy powder except that as the amorphous alloy powder, an amorphous alloy material having an alloy composition shown in Table 11 was used, and by using the obtained dust cores, choke coils were obtained.

TABLE 11

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/(a + b) | b/(c + d) | (a + b)/(c + d + e) | a + e |
| | | at % | | | | | | | | | | | |
| Sample No. 1 | Example 8C | 0.74 | 1.31 | 12.61 | 10.22 | 1.99 | 73.13 | 1.78 | 2.05 | 0.97 | 0.06 | 0.08 | 2.73 |
| Sample No. 2 | Example 1C | 2.27 | 0.96 | 11.09 | 10.10 | 2.01 | 73.58 | 0.42 | 3.23 | 0.62 | 0.05 | 0.14 | 4.28 |
| Sample No. 3 | Comparative Example 2C | 3.13 | 2.59 | 12.68 | 9.28 | 2.00 | 70.31 | 0.83 | 5.72 | 0.35 | 0.12 | 0.24 | 5.13 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 1 | Example 8C | Spinning water | 35.4 | 654 | 1.75 | 1.20 | 52.9 | 50.4 | 299.3 | C |
| Sample No. 2 | Example 1C | Spinning water | 38.2 | 465 | 1.31 | 1.38 | 71.6 | 71.1 | 195.6 | A |
| Sample No. 3 | Comparative Example 2C | Spinning water | 26.3 | 223 | 1.45 | 0.95 | 50.9 | 46.1 | 227.8 | A |

Examples 2C to 5C and Comparative Example 3C

Dust cores were obtained in the same manner as in the above-described Example 28A of the first embodiment of the amorphous alloy powder except that as the amorphous alloy powder, an amorphous alloy material having an alloy composition shown in Table 12 was used, and by using the obtained dust cores, choke coils were obtained.

TABLE 12

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a + b) | b/ (c + d) | (a + b)/ (c + d + e) | a + e |
| | | at % | | | | | | | | | | | |
| Sample No. 4 | Comparative Example 3C | 2.28 | 0.00 | 13.21 | 8.79 | 2.01 | 73.72 | 0.00 | 2.28 | 0.88 | 0.00 | 0.10 | 4.29 |
| Sample No. 5 | Example 2C | 2.45 | 0.07 | 11.90 | 10.81 | 2.36 | 72.41 | 0.03 | 2.52 | 0.94 | 0.00 | 0.10 | 4.82 |
| Sample No. 6 | Example 3C | 2.55 | 0.20 | 11.98 | 10.98 | 2.13 | 72.16 | 0.08 | 2.75 | 0.77 | 0.01 | 0.11 | 4.68 |
| Sample No. 7 | Example 4C | 2.73 | 0.49 | 11.29 | 11.03 | 2.02 | 72.44 | 0.18 | 3.23 | 0.63 | 0.02 | 0.13 | 4.76 |
| Sample No. 8 | Example 5C | 2.67 | 0.72 | 11.90 | 10.64 | 1.60 | 72.47 | 0.27 | 3.39 | 0.47 | 0.03 | 0.14 | 4.27 |

| | | Powdering method | Average particle diameter μm | Oxygen content ppm | Coer-cive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 4 | Comparative Example 3C | Spinning water | 42.3 | 756 | 1.89 | 1.21 | 58.6 | 56.2 | 361.2 | D |
| Sample No. 5 | Example 2C | Spinning water | 27.1 | 311 | 0.75 | 1.39 | 88.4 | 88.4 | 132.5 | C |
| Sample No. 6 | Example 3C | Spinning water | 25.4 | 297 | 0.72 | 1.39 | 94.1 | 91.7 | 128.2 | A |
| Sample No. 7 | Example 4C | Spinning water | 24.5 | 279 | 0.67 | 1.39 | 100.9 | 98.0 | 112.3 | A |
| Sample No. 8 | Example 5C | Spinning water | 26.3 | 215 | 0.60 | 1.37 | 106.5 | 103.6 | 104.6 | A |

Examples 6C and 7C and Comparative Examples 4C and 5C

Dust cores were obtained in the same manner as in the above-described Example 28A of the first embodiment of the amorphous alloy powder except that as the amorphous alloy powder, an amorphous alloy material having an alloy composition shown in Table 13 was used, and by using the obtained dust cores, choke coils were obtained.

TABLE 13

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a + b) | b/ (c +d) | (a + b)/ (c + d + e) | a + e |
| | | | | | at % | | | | | | | | |
| Sample No. 9 | Comparative Example 4C | 1.17 | 1.16 | 11.22 | 9.92 | 0.24 | 76.29 | 1.00 | 2.33 | 0.10 | 0.06 | 0.11 | 1.41 |
| Sample No. 10 | Example 6C | 2.11 | 0.98 | 11.29 | 11.06 | 1.33 | 73.23 | 0.46 | 3.09 | 0.43 | 0.04 | 0.13 | 3.44 |
| Sample No. 11 | Example 7C | 2.21 | 0.69 | 11.08 | 11.37 | 2.66 | 71.98 | 0.31 | 2.90 | 0.92 | 0.03 | 0.12 | 4.88 |
| Sample No. 12 | Comparative Example 5C | 2.39 | 2.11 | 11.19 | 11.73 | 3.91 | 68.66 | 0.88 | 4.50 | 0.87 | 0.09 | 0.17 | 6.30 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corro-sion resis-tance |
|---|---|---|---|---|---|---|---|---|---|---|
| Sample No. 9 | Comparative Example 4C | Spinning water | 20.8 | 264 | 2.26 | 1.12 | 63.3 | 60.9 | 342.3 | D |
| Sample No. 10 | Example 6C | W-atm | 13.5 | 1125 | 1.11 | 1.37 | 97.3 | 94.9 | 178.6 | B |

TABLE 13-continued

| | | | | | | | | | | |
|---|---|---|---|---|---|---|---|---|---|---|
| Sample No. 11 | Example 7C | Spinning water | 25.9 | 301 | 0.69 | 1.28 | 73.6 | 71.2 | 104.5 | A |
| Sample No. 12 | Comparative Example 5C | Spinning water | 32.1 | 314 | 1.52 | 1.04 | 64.8 | 62.4 | 233.7 | B |

Incidentally, in Example 6C, in place of the high-speed spinning water atomization method, a water atomization method (represented by "W-atm" in the table) was used.

2. Evaluation of Amorphous Alloy Powder, Dust Core, and Choke Coil

The amorphous alloy powders and the choke coils obtained in the respective Examples and Comparative Examples were evaluated using the same evaluation methods as those used in "Examples of First Embodiment of Amorphous Alloy Powder" described above. The evaluation results are shown in each table.

As apparent from each table, it was confirmed that the amorphous alloy powders and the choke coils obtained in the respective Examples have a low coercive force and a high magnetic permeability μ'. Accordingly, it was confirmed that the amorphous alloy powders used for producing the choke coils have a smaller magnetostriction than the amorphous alloy powders obtained in the respective Comparative Examples. Further, it was confirmed that the amorphous alloy powders and the choke coils obtained in the respective Examples have a high saturation magnetic flux density and excellent corrosion resistance.

Examples of Fourth Embodiment of Amorphous Alloy Powder

1. Production of Dust Core and Choke Coil

Examples 1D to 7D and Comparative Examples 1D to 3D

Dust cores were obtained in the same manner as in the above-described Example 28A of the first embodiment of the amorphous alloy powder except that as the amorphous alloy powder, an amorphous alloy material having an alloy composition shown in Table 14 was used, and by using the obtained dust cores, choke coils were obtained.

TABLE 14

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a + b) | (a + b)/ (c + d + e) | b/ (c + d) | a + e |
| | | at % | | | | | | | | | | | |
| Sample No. 1 | Example 1D | 2.27 | 0.96 | 11.09 | 10.10 | 2.01 | 73.58 | 0.42 | 3.23 | 0.62 | 0.14 | 0.05 | 4.28 |
| Sample No. 2 | Example 2D | 2.28 | 1.00 | 12.00 | 9.00 | 2.02 | 73.69 | 0.44 | 3.29 | 0.61 | 0.14 | 0.05 | 4.30 |
| Sample No. 3 | Example 3D | 2.28 | 1.14 | 13.21 | 8.78 | 2.01 | 72.58 | 0.50 | 3.42 | 0.59 | 0.14 | 0.05 | 4.29 |
| Sample No. 4 | Example 4D | 2.28 | 1.50 | 11.50 | 8.99 | 1.98 | 73.75 | 0.66 | 3.78 | 0.52 | 0.17 | 0.07 | 4.26 |
| Sample No. 5 | Example 5D | 2.28 | 2.00 | 11.00 | 9.01 | 1.99 | 73.72 | 0.88 | 4.28 | 0.46 | 0.19 | 0.10 | 4.27 |
| Sample No. 6 | Example 6D | 2.49 | 2.20 | 11.30 | 8.99 | 2.02 | 72.99 | 0.88 | 4.70 | 0.43 | 0.21 | 0.11 | 4.52 |
| Sample No. 7 | Example 7D | 2.83 | 2.40 | 12.19 | 9.22 | 2.16 | 71.19 | 0.85 | 5.23 | 0.41 | 0.22 | 0.11 | 5.00 |
| Sample No. 8 | Example 21D | 0.80 | 0.64 | 11.08 | 11.17 | 2.03 | 74.28 | 0.80 | 1.44 | 1.41 | 0.06 | 0.03 | 2.83 |
| Sample No. 9 | Comparative Example 2D | 0.00 | 2.27 | 11.32 | 11.03 | 2.18 | 73.20 | — | 2.27 | 0.96 | 0.09 | 0.10 | 2.18 |
| Sample No. 10 | Comparative Example 3D | 0.00 | 4.57 | 11.25 | 11.14 | 2.22 | 70.82 | — | 4.57 | 0.48 | 0.19 | 0.20 | 2.22 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm =50 mT 100 kHz kW/m³ | Corrosion resistance |
|---|---|---|---|---|---|---|---|---|---|---|
| Sample No. 1 | Example 1D | Spinning water | 38.2 | 465 | 1.31 | 1.38 | 71.6 | 71.1 | 195.6 | A |
| Sample No. 2 | Example 2D | Spinning water | 33.2 | 312 | 1.32 | 1.38 | 66.5 | 62.1 | 210.8 | B |
| Sample No. 3 | Example 3D | Spinning water | 47.2 | 311 | 1.30 | 1.30 | 67.2 | 65.1 | 208.2 | A |
| Sample No. 4 | Example 4D | Spinning water | 35.4 | 302 | 1.15 | 1.39 | 81.6 | 79.8 | 174.0 | A |
| Sample No. 5 | Example 5D | Spinning water | 36.4 | 382 | 0.86 | 1.39 | 108.8 | 106.4 | 130.6 | A |
| Sample No. 6 | Example 6D | Spinning water | 42.3 | 256 | 0.78 | 1.33 | 119.9 | 116.2 | 118.5 | A |
| Sample No. 7 | Example 7D | Spinning water | 25.4 | 230 | 0.72 | 1.20 | 130.5 | 125.4 | 108.8 | A |
| Sample No. 8 | Example 21D | Spinning water | 28.6 | 723 | 1.87 | 0.88 | 52.6 | 50.1 | 288.0 | E |
| Sample No. 9 | Comparative Example 2D | Spinning water | 21.7 | 674 | 1.76 | 0.85 | 62.1 | 60.5 | 330.3 | E |
| Sample No. 10 | Comparative Example 3D | Spinning water | 33.4 | 563 | 1.58 | 0.68 | 52.7 | 51.4 | 304.5 | E |

Examples 8D to 14D and Comparative Examples 4D to 7D

Dust cores were obtained in the same manner as in the above-described Example 28A of the first embodiment of the amorphous alloy powder except that as the amorphous alloy powder, an amorphous alloy material having an alloy composition shown in Table 15 was used, and by using the obtained dust cores, choke coils were obtained.

TABLE 15

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a + b) | (a + b)/ (c + d + e) | b/ (c + d) | a + e |
| | | at % | | | | | | | | | | | |
| Sample No. 11 | Comparative Example 4D | 2.28 | 0.00 | 13.21 | 8.79 | 2.01 | 73.72 | 0.00 | 2.28 | 0.88 | 0.10 | 0.00 | 4.29 |
| Sample No. 12 | Comparative Example 5D | 1.32 | 0.21 | 9.57 | 11.13 | 2.16 | 75.61 | 0.16 | 1.53 | 1.41 | 0.07 | 0.01 | 3.48 |
| Sample No. 13 | Example 8D | 1.39 | 0.72 | 11.87 | 10.61 | 2.03 | 73.39 | 0.52 | 2.10 | 0.96 | 0.09 | 0.03 | 3.41 |
| Sample No. 14 | Comparative Example 6D | 1.37 | 3.09 | 9.54 | 10.82 | 2.44 | 72.74 | 2.26 | 4.46 | 0.55 | 0.20 | 0.15 | 3.81 |
| Sample No. 15 | Comparative Example 7D | 3.48 | 3.08 | 10.43 | 8.99 | 1.99 | 72.02 | 0.89 | 6.56 | 0.30 | 0.31 | 0.16 | 5.47 |
| Sample No. 16 | Example 9D | 2.21 | 2.11 | 10.23 | 11.18 | 2.30 | 71.97 | 0.95 | 4.31 | 0.53 | 0.18 | 0.10 | 4.51 |
| Sample No. 17 | Example 10D | 2.29 | 1.00 | 11.79 | 8.50 | 2.42 | 74.00 | 0.44 | 3.29 | 0.73 | 0.15 | 0.05 | 4.70 |
| Sample No. 18 | Example 11D | 2.29 | 1.15 | 11.61 | 8.83 | 2.45 | 73.67 | 0.50 | 3.44 | 0.71 | 0.15 | 0.06 | 4.74 |
| Sample No. 19 | Example 12D | 2.25 | 1.48 | 11.68 | 9.71 | 2.47 | 72.42 | 0.66 | 3.73 | 0.66 | 0.16 | 0.07 | 4.72 |
| Sample No. 20 | Example 13D | 2.24 | 1.96 | 10.65 | 10.67 | 2.50 | 71.98 | 0.88 | 4.20 | 0.59 | 0.18 | 0.09 | 4.73 |
| Sample No. 21 | Example 14D | 2.20 | 1.93 | 10.29 | 21.70 | 2.46 | 70.42 | 0.88 | 4.13 | 0.59 | 0.16 | 0.08 | 4.65 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 11 | Comparative Example 4D | Spinning water | 42.3 | 756 | 1.89 | 1.38 | 58.6 | 58.2 | 361.2 | D |
| Sample No. 12 | Comparative Example 5D | Spinning water | 25.4 | 330 | 1.45 | 1.38 | 55.2 | 50.8 | 254.7 | D |
| Sample No. 13 | Example 8D | Spinning water | 26.3 | 246 | 0.69 | 1.36 | 112.4 | 110.3 | 104.6 | A |
| Sample No. 14 | Comparative Example 6D | Spinning water | 33.4 | 412 | 1.52 | 0.84 | 70.1 | 68.0 | 243.5 | C |
| Sample No. 15 | Comparative Example 7D | Spinning water | 31.2 | 215 | 1.75 | 0.61 | 125.9 | 123.6 | 284.6 | B |
| Sample No. 16 | Example 9D | W-atm | 9.8 | 1012 | 0.82 | 1.14 | 114.6 | 110.2 | 123.9 | A |
| Sample No. 17 | Example 10D | W-atm | 8.5 | 1123 | 1.41 | 1.41 | 81.2 | 79.6 | 219.8 | B |
| Sample No. 18 | Example 11D | Spinning water | 35.2 | 264 | 1.40 | 1.38 | 85.5 | 81.0 | 207.1 | A |
| Sample No. 19 | Example 12D | W-atm | 10.6 | 945 | 1.16 | 1.29 | 90.6 | 88.5 | 176.2 | A |
| Sample No. 20 | Example 13D | Spinning water | 29.0 | 248 | 0.88 | 1.26 | 106.8 | 105.0 | 133.0 | A |
| Sample No. 21 | Example 14D | Spinning water | 26.4 | 284 | 0.82 | 1.24 | 105.0 | 102.6 | 129.6 | A |

Incidentally, in Examples 9D, 10D, and 12D, in place of the high-speed spinning water atomization method, a water atomization method (represented by "W-atm" in the table) was used.

Examples 15D to 20D

Dust cores were obtained in the same manner as in the above-described Example 28A of the first embodiment of the amorphous alloy powder except that as the amorphous alloy powder, an amorphous alloy material having an alloy composition shown in Table 16 was used, and by using the obtained dust cores, choke coils were obtained.

As apparent from each table, it was confirmed that the amorphous alloy powders and the choke coils obtained in the respective Examples have a low coercive force and a high magnetic permeability μ'. Further, it was confirmed that the choke coils obtained in the respective Examples have a high saturation magnetic flux density and excellent corrosion resistance. Accordingly, it was confirmed that each of the amorphous alloy powders used for producing these choke coils can produce a dust core which achieves a high magnetic permeability and a low iron loss for a long period of time.

TABLE 16

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/(a + b) | (a + b)/(c + d + e) | b/(c + d) | a + e |
| | | at % | | | | | | | | | | | |
| Sample No. 22 | Example 15D | 2.27 | 1.00 | 11.03 | 10.79 | 1.34 | 73.57 | 0.44 | 3.27 | 0.41 | 0.14 | 0.05 | 3.61 |
| Sample No. 23 | Example 16D | 2.11 | 0.98 | 11.29 | 11.06 | 1.33 | 73.23 | 0.46 | 3.09 | 0.43 | 0.13 | 0.04 | 3.44 |
| Sample No. 24 | Example 17D | 2.25 | 1.13 | 11.25 | 11.33 | 2.13 | 71.91 | 0.50 | 3.38 | 0.63 | 0.14 | 0.05 | 4.38 |
| Sample No. 25 | Example 18D | 2.22 | 1.46 | 11.28 | 11.63 | 2.24 | 71.16 | 0.66 | 3.68 | 0.61 | 0.15 | 0.06 | 4.46 |
| Sample No. 26 | Example 19D | 2.21 | 1.94 | 11.07 | 11.36 | 2.74 | 70.67 | 0.88 | 4.15 | 0.66 | 0.16 | 0.09 | 4.95 |
| Sample No. 27 | Example 20D | 2.21 | 0.69 | 11.08 | 11.37 | 2.66 | 71.98 | 0.31 | 2.90 | 0.92 | 0.12 | 0.03 | 4.88 |

| | | Powdering method | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m³ | Corrosion resistance |
|---|---|---|---|---|---|---|---|---|---|---|
| Sample No. 22 | Example 15D | W-atm | 11.2 | 879 | 1.09 | 1.37 | 85.6 | 83.6 | 165.8 | B |
| Sample No. 23 | Example 16D | W-atm | 13.5 | 1125 | 1.11 | 1.37 | 97.3 | 96.9 | 178.6 | B |
| Sample No. 24 | Example 17D | Spinning water | 25.9 | 294 | 1.03 | 1.25 | 91.2 | 86.8 | 155.7 | A |
| Sample No. 25 | Example 18D | W-atm | 8.9 | 1254 | 1.01 | 1.20 | 92.6 | 90.6 | 153.3 | A |
| Sample No. 26 | Example 19D | Spinning water | 27.6 | 301 | 0.89 | 1.17 | 105.6 | 103.8 | 134.5 | A |
| Sample No. 27 | Example 20D | Spinning water | 25.9 | 301 | 0.69 | 1.17 | 73.6 | 71.3 | 104.5 | A |

Incidentally, in Examples 15D, 16D, and 18D, in place of the high-speed spinning water atomization method, a water atomization method (represented by "W-atm" in the table) was used.

2. Evaluation of Amorphous Alloy Powder, Dust Core, and Choke Coil

The amorphous alloy powders and the choke coils obtained in the respective Examples and Comparative Examples were evaluated using the same evaluation methods as those used in "Examples of First Embodiment of Amorphous Alloy Powder" described above. The evaluation results are shown in each table.

Examples of Fifth Embodiment of Amorphous Alloy Powder

1. Production of Dust Core and Choke Coil

Examples 1E to 10E and Comparative Examples 1E and 2E

Dust cores were obtained in the same manner as in the above-described Example 28A of the first embodiment of the amorphous alloy powder except that as the amorphous alloy powder, an amorphous alloy material having an alloy composition shown in Table 17 was used, and by using the obtained dust cores, choke coils were obtained.

TABLE 17

| | | Alloy composition | | | | | | | | | | | |
|---|---|---|---|---|---|---|---|---|---|---|---|---|---|
| | | Cr a | Mn b | Si c | B d at % | C e | Fe | b/a | a + b | e/ (a + b) | (a + b)/ (c + d + e) | b/ (c + d) | a + e |
| Sample No. 1 | Example 1E | 1.00 | 1.05 | 11.01 | 11.02 | 1.99 | 73.93 | 1.05 | 2.05 | 0.97 | 0.09 | 0.05 | 2.99 |
| Sample No. 2 | Example 2E | 0.78 | 1.33 | 12.09 | 10.61 | 1.91 | 73.27 | 1.70 | 2.11 | 0.90 | 0.09 | 0.06 | 2.69 |
| Sample No. 3 | Example 3E | 1.14 | 1.28 | 11.00 | 11.02 | 1.99 | 73.57 | 1.13 | 2.42 | 0.82 | 0.10 | 0.06 | 3.13 |
| Sample No. 4 | Example 4E | 1.11 | 1.54 | 11.97 | 9.90 | 2.00 | 73.49 | 1.38 | 2.65 | 0.76 | 0.11 | 0.07 | 3.12 |
| Sample No. 5 | Example 5E | 1.13 | 1.72 | 12.02 | 10.98 | 2.17 | 71.98 | 1.52 | 2.85 | 0.76 | 0.11 | 0.07 | 3.30 |
| Sample No. 6 | Example 6E | 1.11 | 2.00 | 12.55 | 10.16 | 2.22 | 71.95 | 1.79 | 3.11 | 0.71 | 0.12 | 0.09 | 3.33 |
| Sample No. 7 | Example 7E | 1.11 | 2.16 | 11.55 | 9.82 | 2.16 | 73.20 | 1.95 | 3.26 | 0.66 | 0.14 | 0.10 | 3.27 |
| Sample No. 8 | Example 8E | 1.60 | 2.95 | 11.12 | 9.74 | 1.90 | 72.70 | 1.84 | 4.54 | 0.42 | 0.20 | 0.14 | 3.49 |
| Sample No. 9 | Example 9E | 2.00 | 2.20 | 11.30 | 9.00 | 2.02 | 73.47 | 1.10 | 4.20 | 0.48 | 0.19 | 0.11 | 4.02 |
| Sample No. 10 | Example 10E | 2.25 | 2.97 | 13.24 | 11.48 | 2.52 | 67.56 | 1.32 | 5.21 | 0.48 | 0.19 | 0.12 | 4.76 |
| Sample No. 11 | Example 11E | 0.67 | 0.75 | 10.82 | 12.21 | 2.24 | 73.31 | 1.12 | 1.42 | 1.58 | 0.06 | 0.03 | 2.91 |
| Sample No. 12 | Comparative Example 2E | 0.00 | 2.27 | 11.32 | 11.03 | 2.18 | 73.20 | — | 2.27 | 0.96 | 0.09 | 0.10 | 2.18 |

| | | Average particle diameter μm | Oxygen content ppm | Coercive force Oe | Saturation magnetic flux density T | Magnetic permeability μ' 100 kHz | Magnetic permeability μ' 1000 kHz | Iron loss Bm = 50 mT 100 kHz kW/m3 | Corrosion resistance |
|---|---|---|---|---|---|---|---|---|---|
| Sample No. 1 | Example 1E | 37.5 | 632 | 1.44 | 1.35 | 51.6 | 51.0 | 268.0 | C |
| Sample No. 2 | Example 2E | 37.5 | 725 | 1.44 | 1.35 | 55.7 | 54.8 | 259.8 | D |
| Sample No. 3 | Example 3E | 37.5 | 485 | 1.24 | 1.38 | 80.5 | 79.9 | 189.6 | B |
| Sample No. 4 | Example 4E | 36.4 | 475 | 1.21 | 1.38 | 85.2 | 84.3 | 175.7 | B |
| Sample No. 5 | Example 5E | 35.6 | 428 | 1.19 | 1.38 | 106.6 | 103.5 | 169.5 | B |
| Sample No. 6 | Example 6E | 34.2 | 397 | 0.98 | 1.37 | 139.7 | 136.5 | 119.5 | B |
| Sample No. 7 | Example 7E | 33.8 | 378 | 0.94 | 1.36 | 145.2 | 142.6 | 113.5 | C |
| Sample No. 8 | Example 8E | 34.6 | 456 | 0.75 | 1.37 | 160.2 | 158.5 | 109.0 | B |
| Sample No. 9 | Example 9E | 42.3 | 256 | 0.78 | 1.33 | 119.9 | 116.2 | 118.5 | B |
| Sample No. 10 | Example 10E | 33.25 | 269 | 0.58 | 1.12 | 161.4 | 159.6 | 88.0 | A |
| Sample No. 11 | Example 11E | 28.6 | 715 | 1.85 | 0.87 | 54.7 | 52.5 | 278.6 | E |
| Sample No. 12 | Comparative Example 2E | 21.7 | 674 | 1.76 | 0.85 | 62.1 | 60.5 | 330.3 | E |

Comparative Examples 3E to 8E

Dust cores were obtained in the same manner as in the above-described Example 28A of the first embodiment of the amorphous alloy powder except that as the amorphous alloy powder, an amorphous alloy material having an alloy composition shown in Table 18 was used, and by using the obtained dust cores, choke coils were obtained.

TABLE 18

| | | Alloy composition | | | | | | | | | | | |
|---|---|---|---|---|---|---|---|---|---|---|---|---|---|
| | | Cr a | Mn b | Si c | B d | C e | Fe | b/a | a + b | e/ (a + b) | (a + b)/ (c + d + e) | b/ (c + d) | a + e |
| | | | | at % | | | | | | | | | |
| Sample No. 13 | Comparative Example 3E | 2.22 | 0.00 | 10.97 | 10.96 | 2.14 | 73.71 | 0.00 | 2.22 | 0.97 | 0.09 | 0.00 | 4.36 |
| Sample No. 14 | Comparative Example 4E | 1.32 | 0.21 | 9.57 | 11.13 | 2.16 | 75.61 | 0.16 | 1.53 | 1.41 | 0.07 | 0.01 | 3.48 |
| Sample No. 15 | Comparative Example 5E | 2.67 | 5.07 | 11.39 | 11.15 | 2.21 | 67.52 | 1.90 | 7.73 | 0.29 | 0.31 | 0.22 | 4.88 |
| Sample No. 16 | Comparative Example 6E | 1.37 | 3.09 | 9.54 | 10.82 | 2.44 | 72.74 | 2.26 | 4.46 | 0.55 | 0.20 | 0.15 | 3.81 |
| Sample No. 17 | Comparative Example 7E | 3.48 | 11.04 | 10.42 | 8.98 | 1.99 | 64.10 | 3.18 | 14.52 | 0.14 | 0.68 | 0.57 | 5.47 |
| Sample No. 18 | Comparative Example 8E | 3.48 | 3.08 | 10.43 | 8.99 | 1.99 | 72.02 | 0.89 | 6.56 | 0.30 | 0.31 | 0.16 | 5.47 |

| | | Average particle diameter | Oxygen content | Coercive force | Saturation magnetic flux density | Magnetic permeability μ' | | Iron loss Bm = 50 mT 100 kHz | Corrosion |
|---|---|---|---|---|---|---|---|---|---|
| | | μm | ppm | Oe | T | 100 kHz | 1000 kHz | kW/m$^3$ | resistance |
| Sample No. 13 | Comparative Example 3E | 35.0 | 578 | 1.87 | 1.38 | 40.5 | 38.1 | 345.2 | D |
| Sample No. 14 | Comparative Example 4E | 25.4 | 330 | 1.45 | 1.38 | 55.2 | 54.7 | 254.7 | D |
| Sample No. 15 | Comparative Example 5E | 21.7 | 201 | 1.44 | 0.77 | 57.5 | 55.4 | 241.5 | C |
| Sample No. 16 | Comparative Example 6E | 33.4 | 412 | 1.52 | 0.84 | 70.1 | 68.0 | 243.5 | C |
| Sample No. 17 | Comparative Example 7E | 32.1 | 198 | 1.62 | 0.59 | 51.2 | 49.5 | 250.1 | C |
| Sample No. 18 | Comparative Example 8E | 31.2 | 215 | 1.75 | 0.61 | 125.9 | 123.6 | 284.6 | B |

2. Evaluation of Amorphous Alloy Powder, Dust Core, and Choke Coil

The amorphous alloy powders and the choke coils obtained in the respective Examples and Comparative Examples were evaluated using the same evaluation methods as those used in "Examples of First Embodiment of Amorphous Alloy Powder" described above. The evaluation results are shown in each table.

As apparent from each table, it was confirmed that the amorphous alloy powders and the choke coils obtained in the respective Examples have a low coercive force and a high magnetic permeability μ'. Accordingly, it was confirmed that each of the amorphous alloy powders used for producing these choke coils can produce a dust core in which a high magnetic permeability and a low iron loss are stably achieved. Further, it was confirmed that the amorphous alloy powders and the choke coils obtained in the respective Examples have a high saturation magnetic flux density and excellent corrosion resistance.

The entire disclosures of Japanese Patent Application Nos. 2013-038584, 2013-038585, 2013-038586, 2013-038587 and 2013-038588, all filed Feb. 28, 2013 are expressly incorporated by reference herein.

What is claimed is:

1. An amorphous alloy powder, comprising particles of an amorphous alloy material containing Fe, Cr, Mn, Si, B, and C as constituent components, wherein in the amorphous alloy material, Fe is contained as a main component, the content of Cr is 1.0 at % or more and 3 at % or less, the content of Mn is 1.3 at % or more and 2.8 at % or less, the content of Si is 10 at % or more and 14 at % or less, the content of B is 8 at % or more and 13 at % or less, and the content of C is 1 at % or more and 3 at % or less.

2. The amorphous alloy powder according to claim 1, wherein the content of Cr in the amorphous alloy material is a (at %) and the content of Mn therein is b (at %), the value of b/(a+b) is 0.2 or more and 0.72 or less.

3. The amorphous alloy powder according to claim 1, wherein the content of Cr in the amorphous alloy material is a (at %) and the content of Mn therein is b (at %), the value of a+b is 1.5 or more and 5.5 or less.

4. The amorphous alloy powder according to claim 1, wherein the content of Cr in the amorphous alloy material is a (at %), the content of Mn therein is b (at %), the content of Si therein is c (at %), the content of B therein is d (at %), and the content of C therein is e (at %), the value of (a+b)/(c+d+e) is 0.05 or more and 0.25 or less.

5. The amorphous alloy powder according to claim 1, wherein the content of Mn in the amorphous alloy material is b (at %), the content of Si therein is c (at %), and the content of C therein is e (at %), the value of e/(b+c) is 0.07 or more and 0.27 or less.

6. The amorphous alloy powder according to claim 1, wherein the content of Cr in the amorphous alloy material is 1 at % or more and 2.5 at % or less, and the content of Cr in the amorphous alloy material is a (at %), the content of Mn therein is b (at %), and the content of C therein is e (at %), the value of e/(a+b) is 0.2 or more and 0.95 or less.

7. The amorphous alloy powder according to claim 6, wherein the value of a+b is 2.1 or more and 5.3 or less.

8. The amorphous alloy powder according to claim 7, wherein the value of b/a is 0.4 or more and less than 1.

9. The amorphous alloy powder according to claim 7, wherein the value of b/a is 1 or more and 2 or less.

10. The amorphous alloy powder according to claim 6, wherein the content of Si in the amorphous alloy material is c (at %) and the content of B therein is d (at %), the value of b/(c+d) is 0.04 or more and 0.15 or less.

11. The amorphous alloy powder according to claim 1, wherein the content of Cr in the amorphous alloy material is 2 at % or more and 3 at % or less, and the content of Cr in the amorphous alloy material is a (at %), the content of Mn therein is b (at %), and the content of C therein is e (at %), the value of e/(a+b) is 0.3 or more and 0.95 or less.

12. The amorphous alloy powder according to claim 11, wherein the value of a+b is 2.1 or more and 3.8 or less.

13. The amorphous alloy powder according to claim 12, wherein the value of b/a is 0.02 or more and less than 0.47.

14. The amorphous alloy powder according to claim 11, wherein the content of Si in the amorphous alloy material is c (at %) and the content of B therein is d (at %), the value of b/(c+d) is 0.01 or more and 0.05 or less.

15. The amorphous alloy powder according to claim 1, wherein the content of Cr in the amorphous alloy material is a (at %) and the content of Mn therein is b (at %), the value of a+b is 1.5 or more and 5.5 or less, and the value of b/a is 0.3 or more and less than 1.

16. The amorphous alloy powder according to claim 15, wherein the value of b is 0.1 or more and 2.5 or less.

17. The amorphous alloy powder according to claim 15, wherein the content of Si in the amorphous alloy material is c (at %) and the content of B therein is d (at %), the value of b/(c+d) is 0.01 or more and 0.12 or less.

18. The amorphous alloy powder according to claim 15, wherein the content of Si in the amorphous alloy material is c (at %), the content of B therein is d (at %), and the content of C therein is e (at %), the value of (a+b)/(c+d+e) is 0.05 or more and 0.25 or less.

19. The amorphous alloy powder according to claim 1, wherein the content of Cr in the amorphous alloy material is a (at %) and the content of Mn therein is b (at %), the value of a+b is 1.5 or more and 6 or less, and the value of b/a is 1 or more and 2 or less.

20. The amorphous alloy powder according to claim 19, wherein the value of b is 0.5 or more and 3 or less.

21. The amorphous alloy powder according to claim 19, wherein the content of Si in the amorphous alloy material is c (at %) and the content of B therein is d (at %), the value of b/(c+d) is 0.03 or more and 0.15 or less.

22. The amorphous alloy powder according to claim 19, wherein the content of Si in the amorphous alloy material is c (at %), the content of B therein is d (at %), and the content of C therein is e (at %), the value of (a+b)/(c+d+e) is 0.05 or more and 0.25 or less.

23. The amorphous alloy powder according to claim 1, wherein the particles have an average particle diameter of 3 μm or more and 100 μm or less.

24. The amorphous alloy powder according to claim 1, wherein the amorphous alloy material has a coercive force of 4 Oe or less.

25. The amorphous alloy powder according to claim 1, wherein the oxygen content in the particles is 150 ppm by mass or more and 3000 ppm by mass or less.

26. The amorphous alloy powder according to claim 1, wherein the amorphous alloy powder is produced by a water atomization method or a high-speed spinning water atomization method.

27. A dust core, which is formed using an amorphous alloy powder composed of particles of an amorphous alloy material according to claim 1.

28. A magnetic element, comprising the dust core according to claim 27.

29. An electronic device, comprising the magnetic element according to claim 28.

* * * * *